US012239870B2

(12) United States Patent
Petrillo et al.

(10) Patent No.: US 12,239,870 B2
(45) Date of Patent: Mar. 4, 2025

(54) BRAKING SYSTEMS AND METHODS FOR EXERCISE EQUIPMENT

(71) Applicant: Peloton Interactive, Inc., New York, NY (US)

(72) Inventors: David William Petrillo, New York, NY (US); Thomas Philip Cortese, Summit, NJ (US); John Chester Consiglio, Jersey City, NJ (US); Akshay Suresh Kashyap, New York, NY (US)

(73) Assignee: Peloton Interactive, Inc., New York, NY (US)

( * ) Notice: Subject to any disclaimer, the term of this patent is extended or adjusted under 35 U.S.C. 154(b) by 0 days.

(21) Appl. No.: 18/492,680

(22) Filed: Oct. 23, 2023

(65) Prior Publication Data

US 2024/0050794 A1 Feb. 15, 2024

Related U.S. Application Data

(63) Continuation of application No. 17/165,919, filed on Feb. 2, 2021, now Pat. No. 11,794,054, which is a (Continued)

(51) Int. Cl.
*A63B 21/005* (2006.01)
*A63B 21/22* (2006.01)

(Continued)

(52) U.S. Cl.
CPC ..... *A63B 21/0056* (2013.01); *A63B 21/225* (2013.01); *A63B 22/0605* (2013.01);

(Continued)

(58) Field of Classification Search
CPC ..... A63B 21/00047; A63B 21/00058; A63B 21/00069; A63B 21/00072;

(Continued)

(56) References Cited

U.S. PATENT DOCUMENTS 8,052,581 B1 11/2011 Lohr et al.
8,845,493 B2 9/2014 Watterson et al.

(Continued)

FOREIGN PATENT DOCUMENTS

CN 106438764 A 2/2017
CN 207012482 U 2/2018

(Continued)

OTHER PUBLICATIONS

Search Report and Written Opinion mailed on Oct. 24, 2019 in related PCT Patent Application No. PCT/US2019/045013.

(Continued)

*Primary Examiner* — Zachary T Moore

(74) *Attorney, Agent, or Firm* — Haynes and Boone, LLP

(57) ABSTRACT

Systems and methods for adjusting resistance on an exercise apparatus include a first resistance apparatus having an adjusting bracket, magnetic members mounted on an inner surface of the adjusting bracket, a stepper motor having an adjusting shaft and operable to traverse a portion of the length of the adjusting shaft. At a first position, the magnetic members are disposed above a flywheel, and in a second position, the magnetic members are disposed on opposite sides of the flywheel, providing resistance thereto. A load cell couples the adjusting bracket to the frame and generates a signal corresponding to the movement of the adjusting bracket. A computing system calculates resistance, rpms, power from load cell signal, stepper motor position, shaft rotational position and other sensor inputs.

20 Claims, 18 Drawing Sheets

Related U.S. Application Data continuation of application No. PCT/US2019/045013, filed on Aug. 2, 2019.

(60) Provisional application No. 62/714,635, filed on Aug. 3, 2018.

(51) Int. Cl.
*A63B 22/06* (2006.01)
*A63B 71/06* (2006.01)

(52) U.S. Cl.
CPC ..... *A63B 71/0619* (2013.01); *A63B 2220/17* (2013.01); *A63B 2225/50* (2013.01)

(58) Field of Classification Search
CPC ..... A63B 21/00076; A63B 21/00192; A63B 21/005; A63B 21/0051; A63B 21/0052; A63B 21/0053; A63B 21/0054; A63B 21/0055; A63B 21/0056; A63B 21/0057; A63B 21/0058; A63B 21/012; A63B 21/0125; A63B 21/015; A63B 22/06; A63B 22/0605; A63B 22/0664; A63B 22/0694; A63B 22/18; A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 2022/067; A63B 2022/0676; A63B 2022/0682; A63B 2022/0688; A63B 2022/185; A61G 5/1024; F01L 2001/3522; G01L 3/16; G01L 3/18; G01L 3/20; G01L 3/205; G01L 3/22
See application file for complete search history.

(56) References Cited

U.S. PATENT DOCUMENTS

| | | | | |
|---|---|---|---|---|
| 9,364,712 | B2 | 6/2016 | Wu | |
| 9,415,257 | B2 | 8/2016 | Habing | |
| 9,492,700 | B1 | 11/2016 | Wu | |
| 9,707,430 | B2 | 7/2017 | Wu | |
| 9,839,810 | B1 | 12/2017 | Tzeng | |
| 10,391,348 | B2 * | 8/2019 | Gibson | A63B 21/00072 |
| 10,471,297 | B1 | 11/2019 | Smith et al. | |
| 10,639,512 | B2 * | 5/2020 | Huang | A63B 21/015 |
| 11,141,624 | B2 * | 10/2021 | Wu | A63B 21/225 |
| 2006/0003872 | A1 | 1/2006 | Chiles et al. | |
| 2007/0232452 | A1 | 10/2007 | Hanoun | |
| 2010/0298104 | A1 | 11/2010 | Turner | |
| 2013/0337981 | A1 | 12/2013 | Habing | |
| 2014/0013861 | A1 | 1/2014 | Wu | |
| 2016/0310785 | A1 | 10/2016 | Lo | |
| 2017/0036053 | A1 * | 2/2017 | Smith | A63B 21/015 |
| 2017/0056700 | A1 | 3/2017 | Wu | |
| 2017/0239506 | A1 | 8/2017 | Gibson et al. | |
| 2019/0262651 | A1 * | 8/2019 | Huang | A63B 21/015 |
| 2020/0121981 | A1 | 4/2020 | Wu | |

FOREIGN PATENT DOCUMENTS

| | | | |
|---|---|---|---|
| DE | 2018191703 | U1 | 5/2018 |
| EP | 0925096 | B1 | 6/1999 |
| EP | 3000507 | A1 | 3/2016 |
| TW | M565048 | U | 8/2018 |
| TW | M577747 | U | 5/2019 |
| WO | WO 2017/136366 | A1 | 8/2017 |

OTHER PUBLICATIONS

Search Report and Written Opinion mailed on Sep. 1, 2021 in related PCT Patent Application No. PCT/US2021/034632.

Office Action mailed on Nov. 25, 2021 in related Chinese Patent Application Publication No. 201980064522.9.

Office Action mailed on Jul. 5, 2022 in related Japanese Patent No. 7235857.

Office Action mailed on Oct. 20, 2022 in related Taiwanese Patent No. I804877.

Office Action mailed on Aug. 24, 2022 in related Indian Patent Application Publication No. 202117008194.

* cited by examiner

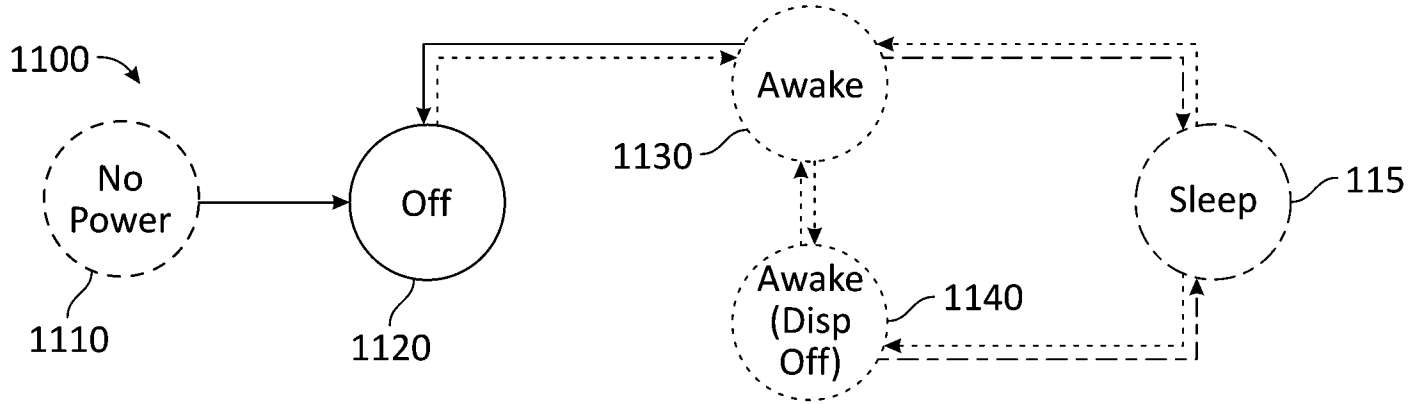

"Appears Asleep to User"

| | System Power State | Brake State | Brake LED | Tablet State | Tablet Display | USBC Power LED | Resistance Control | Description |
|---|---|---|---|---|---|---|---|---|
| 1110 | NO POWER | NO POWER | OFF | NO POWER | OFF | OFF | NO | No Power |
| 1120 | OFF | OFF | OFF | OFF | OFF | ON | NO | Low Power State (e.g., Power<.5W). Applications not Running. |
| 1130 | AWAKE | ON | OFF | ON | ON | ON | YES | Full Power During Use. |
| 1140 | AWAKE (DISPLAY OFF) | ON | OFF | ON | OFF | ON | YES | Appears asleep to User. Allows Background Processing (e.g., Updates, Processing, Data Comm.) |
| 1150 | SLEEP | ON | OFF | SUSPEND | OFF | ON | YES | Power < 2W. Tablet/Display is Suspended in a Low Power State .Tablet Apps and Data Stored in RAM for Quick Resume. Brake is ON and App is Running. |

FIG. 11

BRAKING SYSTEMS AND METHODS FOR EXERCISE EQUIPMENT

CROSS-REFERENCE TO RELATED APPLICATION

This application is a continuation of U.S. patent application Ser. No. 17/165,919 filed Feb. 2, 2021, which is a continuation of International Application No. PCT/US2019/045013 filed Aug. 2, 2019, which claims the benefit of and priority to U.S. Provisional Application No. 62/714,635, filed Aug. 3, 2018, all of which are incorporated by reference as if fully set forth herein. The present disclosure is related to U.S. Pat. No. 11,426,617, which issued Aug. 30, 2022, and which claims priority from U.S. Provisional Application No. 62/618,581, filed Jan. 17, 2018, titled "Braking System and Method for Exercise Equipment," both of which are incorporated by reference as if fully set forth herein.

TECHNICAL FIELD

The present application relates generally to the field of exercise equipment and methods, and more specifically to systems and methods for sensing and/or adjusting resistance in exercise equipment.

BACKGROUND

Modern fitness equipment is often configured to allow a user to adjust the intensity and/or other settings according to personal training goals. The adjustment operation may be difficult and cumbersome for many users, especially during exercise. For example, an exercise cycle, such as a spin bike, may be configured with a torque regulator, allowing a user to adjust the pedal resistance by adjusting a degree of torque to be applied to a flywheel. The torque adjustment can be difficult and take a long time to accurately set, inconveniencing the user during exercise. Further complicating the user experience, an auxiliary brake may also be included to stop the spinning flywheel and the drivetrain for safety purposes. This is usually achieved by a separate friction-based brake that is designed only to be used intermittently to bring the system to a full stop. There is therefore a need for improved systems and methods for operating exercise equipment that increases the convenience to the user and enhances the exercise experience.

BRIEF DESCRIPTION OF THE DRAWINGS

Aspects of the disclosure and their advantages can be better understood with reference to the following drawings and the detailed description that follows. It should be appreciated that like reference numerals are used to identify like elements illustrated in one or more of the figures, wherein showings therein are for purposes of illustrating embodiments of the present disclosure and not for purposes of limiting the same. The components in the drawings are not necessarily to scale, emphasis instead being placed upon clearly illustrating the principles of the present disclosure.

FIG. 11 illustrate example power states for a system for use with exercise apparatus in accordance with one or more embodiments of the present disclosure.

DETAILED DESCRIPTION

In accordance with various embodiments of the present disclosure, systems and methods for sensing and adjusting torque in exercise equipment are provided. In some embodiments, a braking system includes a plurality of magnets providing varying exercise resistance when moved in relation to a flywheel of the exercise apparatus. In some embodiments, a braking system includes both an easy to use and accurate resistance adjustment assembly for adjusting resistance during exercise and an auxiliary brake for bringing the flywheel to a full stop through the same adjustment knob, providing convenience and safety for the operator.

In various embodiments, the resistance adjustment apparatus is operable to control the level of resistance in the resistance brake using electronic systems and methods. Further, it may be desirable to physically measure the amount of torque being applied to the flywheel, and the amount of resistance being felt by the user in order to determine how much instantaneous power is being generated, and how much total work has been done by the user. Physically measuring the level of applied resistance increases the accuracy of the measurement compared to conventional methods that infer an amount of resistance applied by measuring the position of the braking mechanism relative to the flywheel and comparing this measurement to a previously measured and correlated resistance level. The embodiments disclosed herein provide these and other advantages as will be apparent to those skilled in the art.

Figure 1:
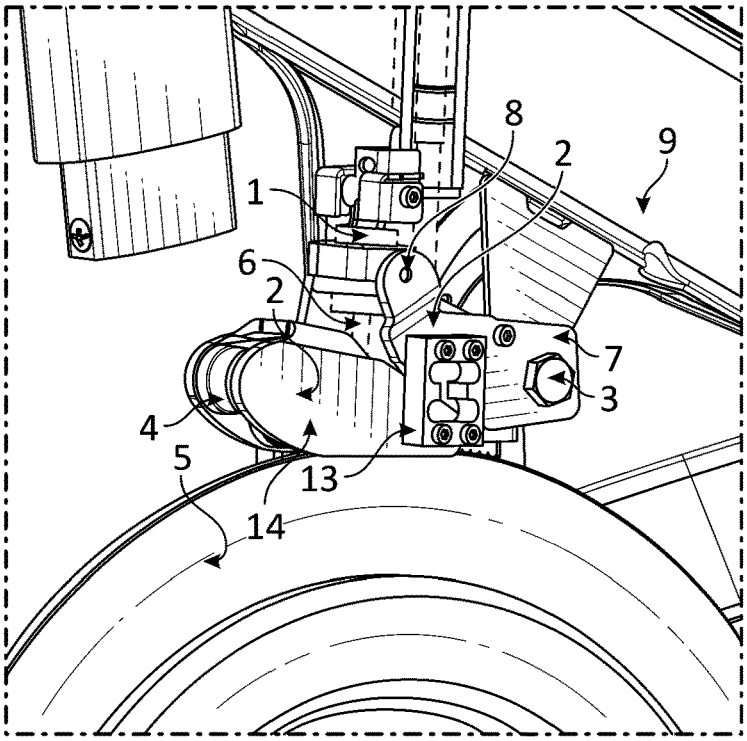
FIG. 1 illustrates a braking system in accordance with one or more embodiments of the present disclosure.
Figure 2:
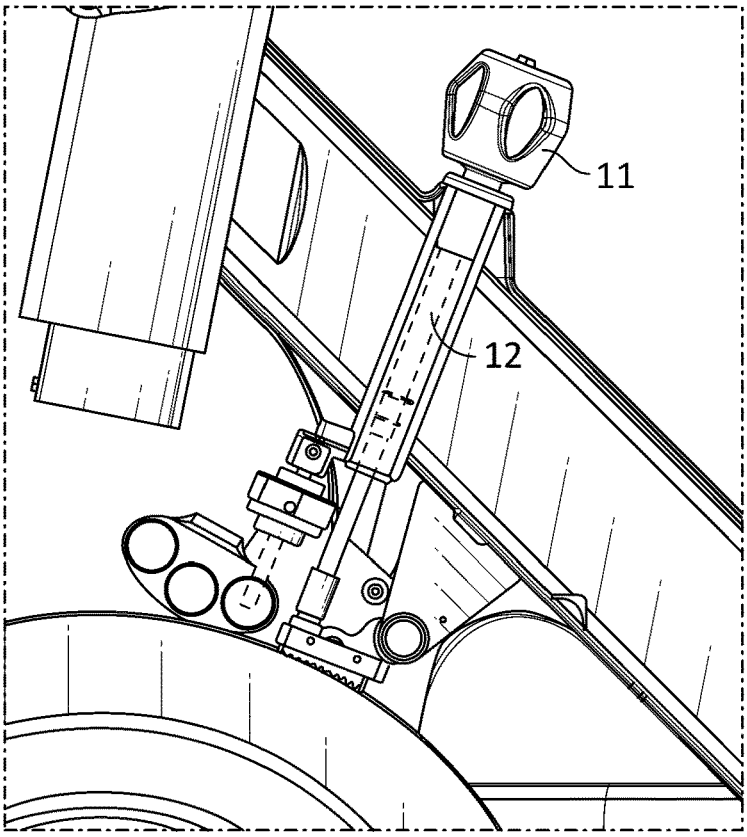
FIG. 2 is a cross section view of an auxiliary braking system in accordance with one or more embodiments of the present disclosure.
Figure 3:
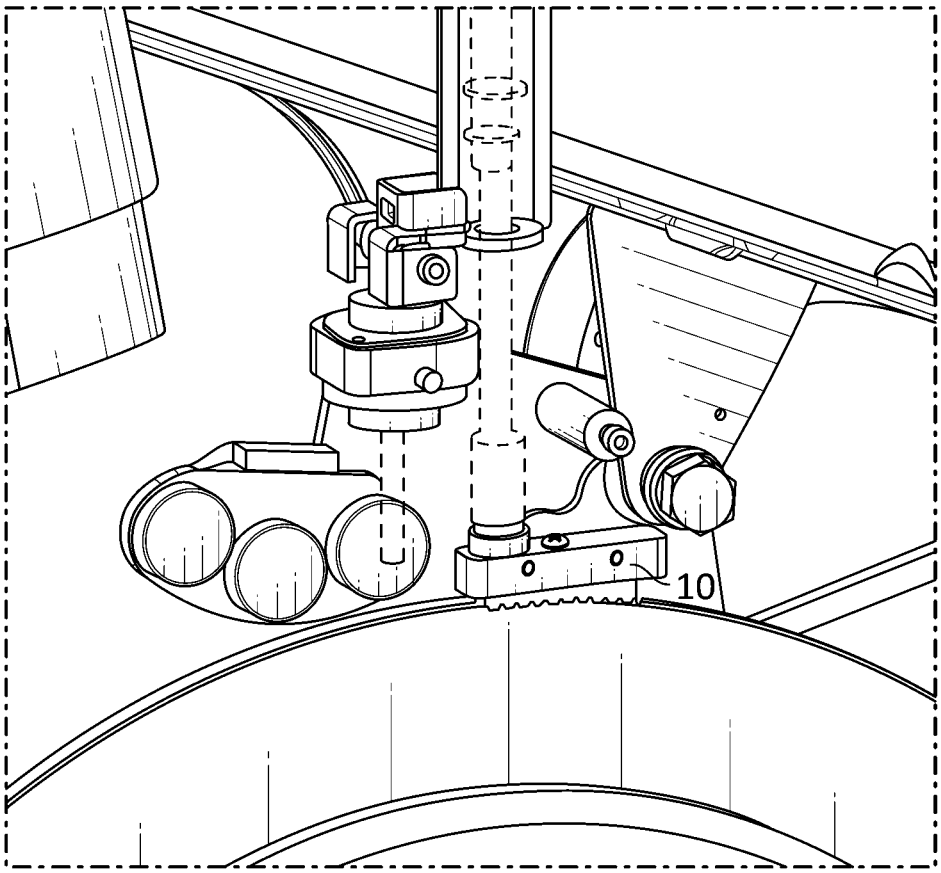
FIG. 3 is a cross section view of an auxiliary braking system in accordance with one or more embodiments of the present disclosure.

Referring to FIGS. 1-3, example embodiments of the present disclosure will now be described. A resistance system includes an electronic resistance assembly operable to adjust the resistance applied to a flywheel 5 of an exercise apparatus. The electronic resistance assembly may include an electrically driven actuator 1 that drives a resistance brake assembly 2 to pivot towards and away from the flywheel 5 about a pivot point 3. In the illustrated embodiment, the pivot point 3 comprises one or more screws, bolts or other components to pivotably attach the resistance brake assembly 2 to a frame of the cycle 9.

The resistance brake assembly 2 includes two or more magnets 4 selected and arranged such that, as the magnets 4 move closer to (e.g., eclipsing the edge of the flywheel 5) and/or further away from the center of the flywheel 5, the amount of resistance can be adjusted from a maximum level to zero. The flywheel 5 may be made of aluminum or other material capable of generating resistive forces while passing through the field of the magnet 4. In one embodiment, the actuator 1 is a stepper motor, such as a permanent magnet linear stepper motor, comprising a shaft 6. The shaft 6 has a first end pivotably attached to the frame of the cycle 9, allowing the shaft 6 to pivot as the stepper motor traverses along the shaft 6. In one embodiment, the fixed end is hinged preventing rotation along its primary axis. The stepper motor body 1 is pivotably attached to the resistance brake assembly 2 at a mounting point 8, allowing the stepper motor 1 to pivot relative to the resistance brake assembly 2 during operation. In operation, the stepper motor 1 is operable to translate up and down the threaded shaft 6, causing the brake assembly 2 to pivot about the pivot point 3. As a result, the magnets 4 are selectively moved up and down relative to the flywheel 5 to adjust the resistance.

Figure 4A:
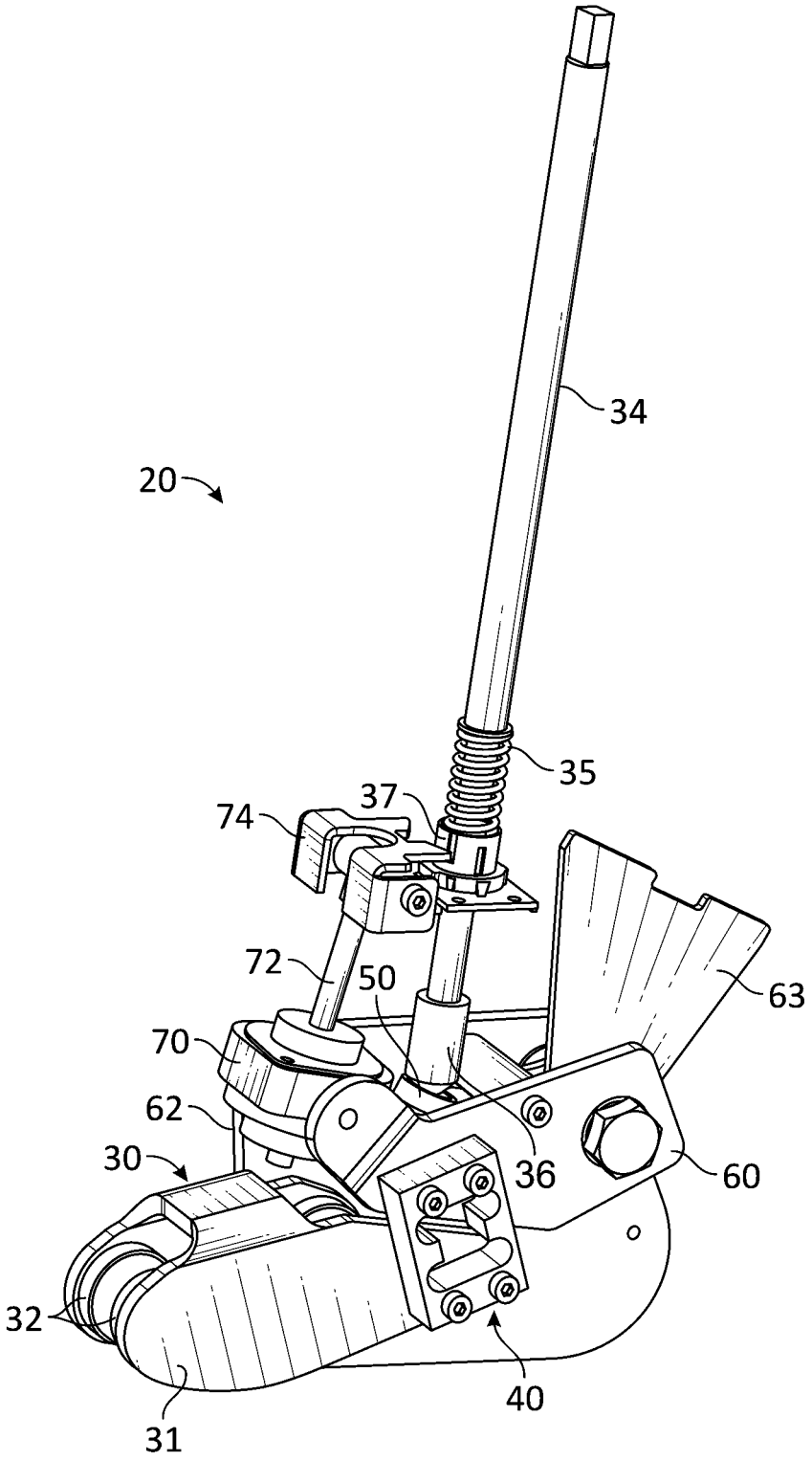
FIG. 4A illustrates a braking system in accordance with one or more embodiments of the present disclosure.
Figure 4B:
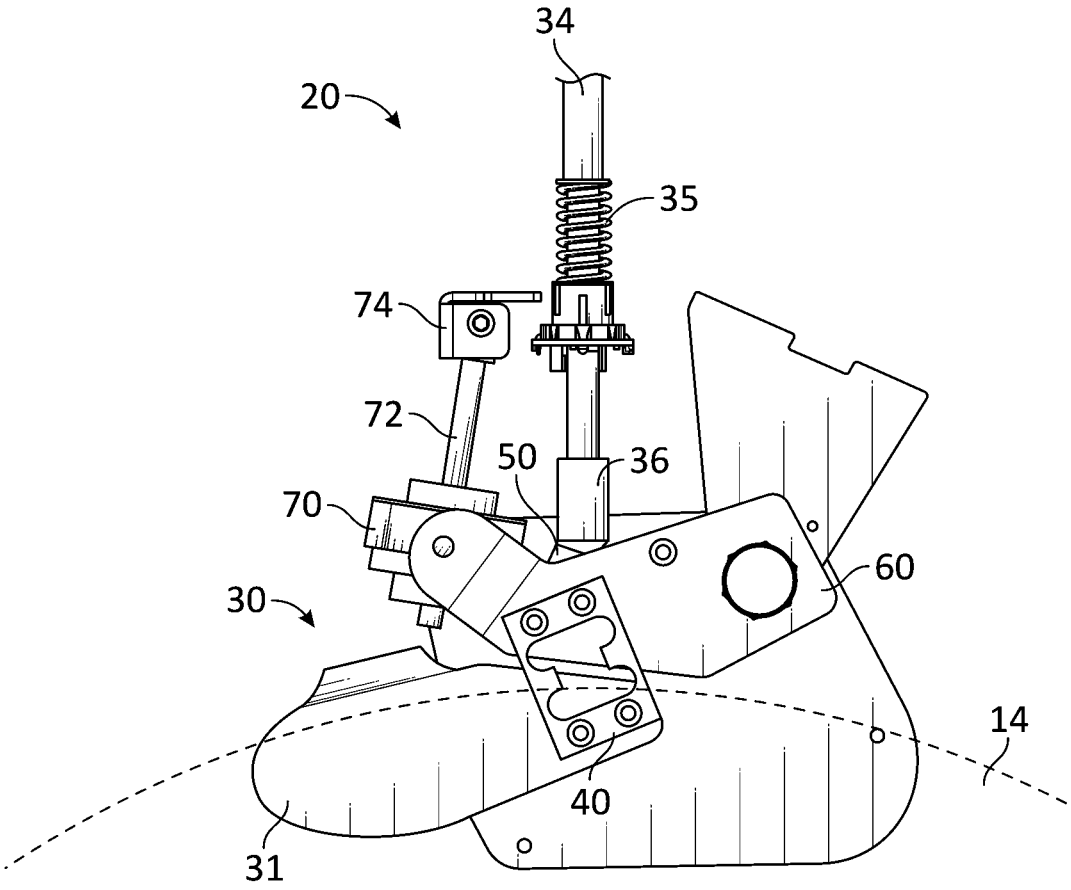
FIG. 4B is a side view of a braking system in accordance with one or more embodiments of the present disclosure.
Figure 4C:
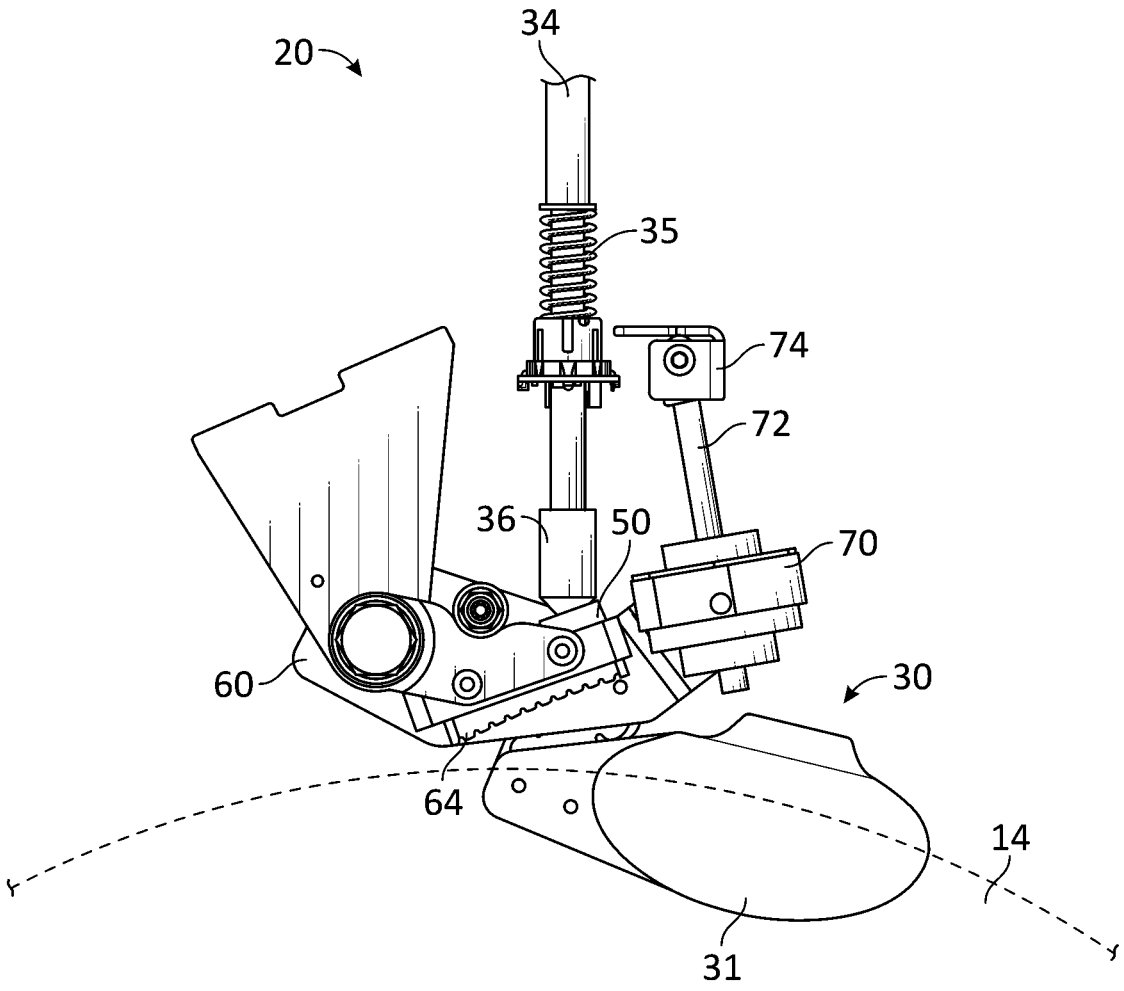
FIG. 4C is a side view of a braking system in accordance with one or more embodiments of the present disclosure.
Figure 4D:
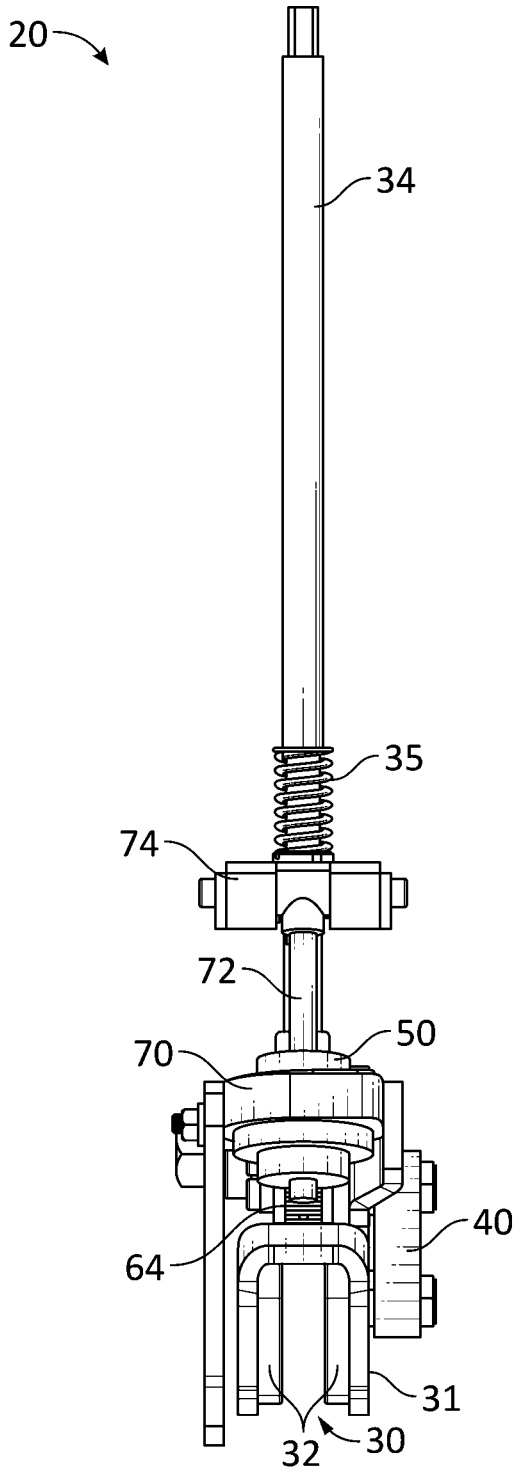
FIG. 4D is a front view of a braking system in accordance with one or more embodiments of the present disclosure.
Figure 4E:
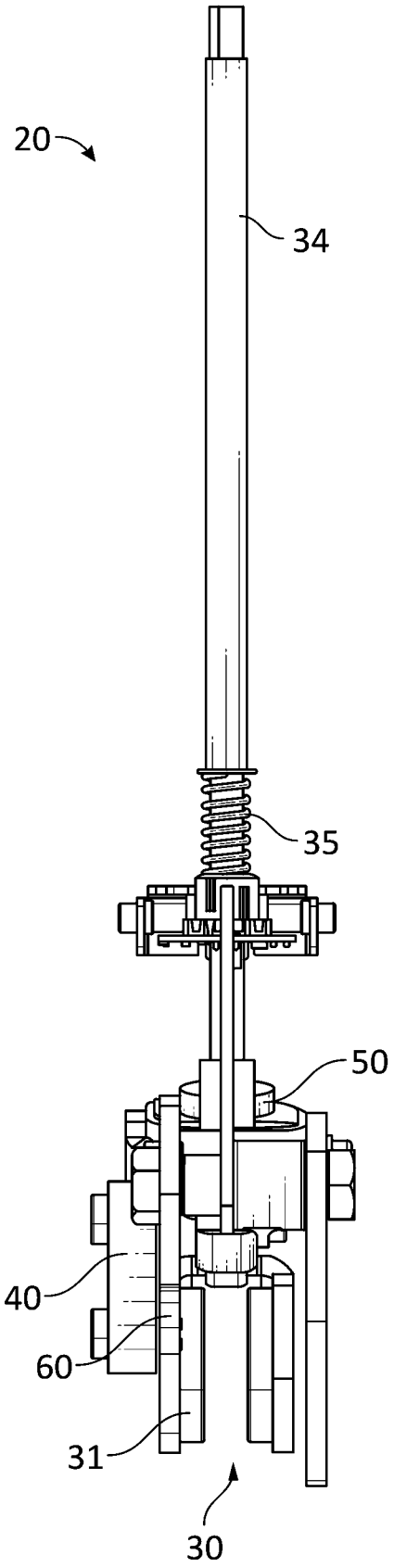
FIG. 4E is a back view of a braking system in accordance with one or more embodiments of the present disclosure.
Figure 4F:
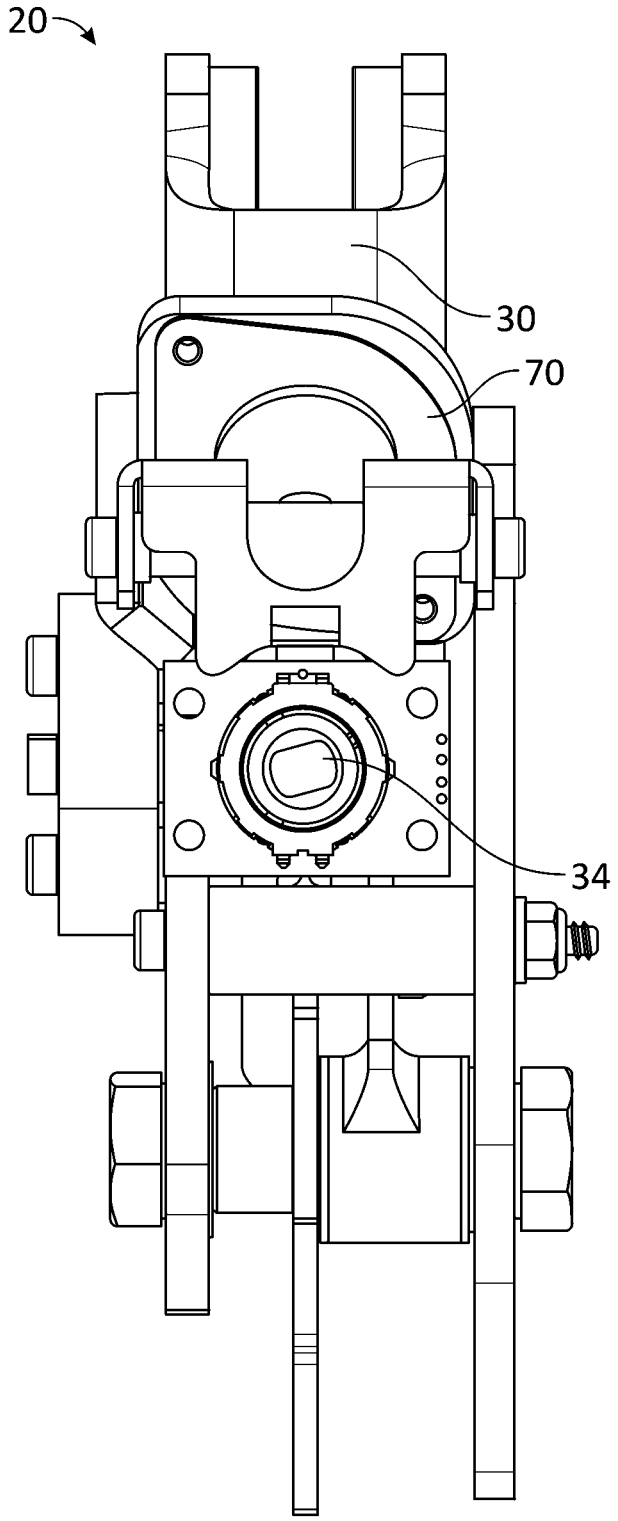
FIG. 4F is a top view of a braking system in accordance with one or more embodiments of the present disclosure.
Figure 4G:
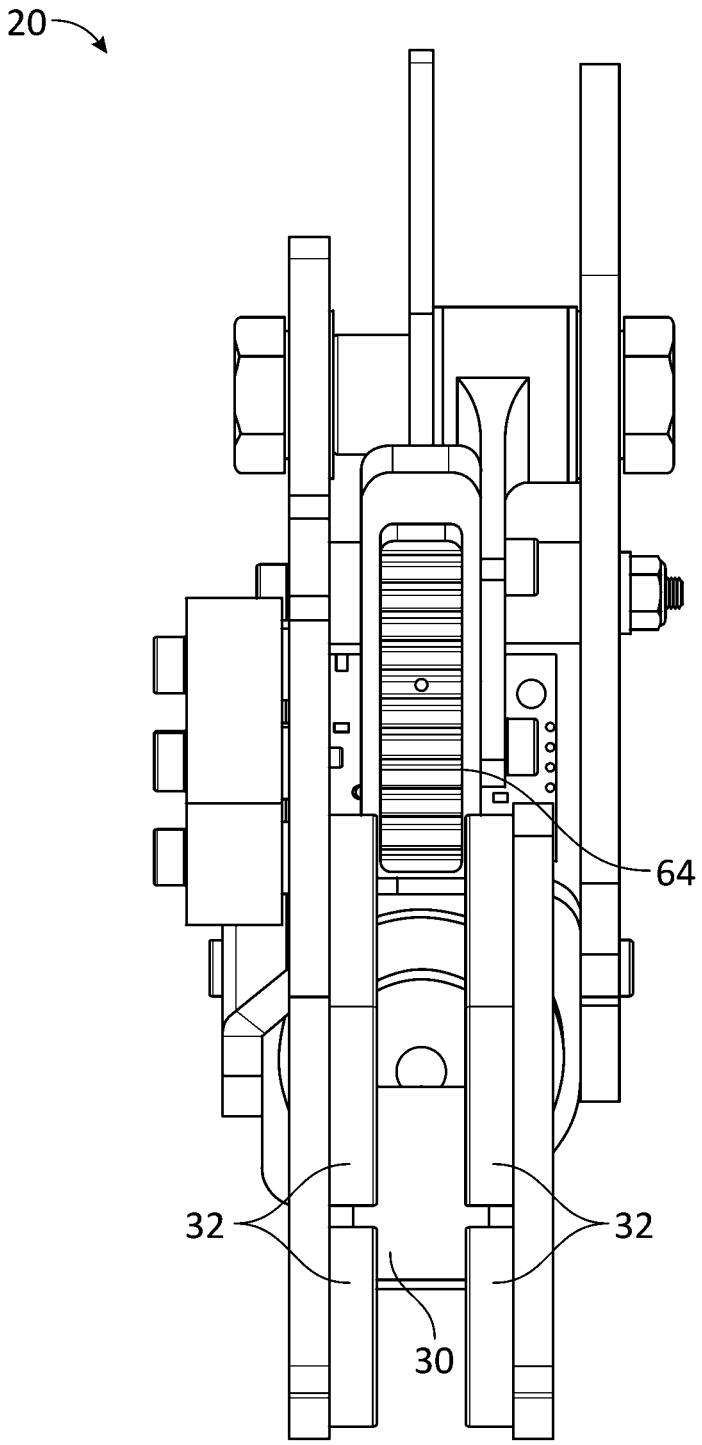
FIG. 4G is a bottom view of a braking system in accordance with one or more embodiments of the present disclosure.

The resistance system further includes an auxiliary brake assembly 10, which can operate independently of the pivoting resistance brake assembly 2. The auxiliary brake assembly 10 may be activated by the operator by pressing down onto an adjustment knob 11, which will cause an elongated adjustment shaft 12 to translate towards the flywheel, causing the pivoting friction brake assembly 10 to pivot towards the flywheel 5, eventually contacting the edge of the flywheel and providing the braking force. Rotating the adjustment knob 11 will cause the elongated adjustment shaft 12 to rotate about its primary axis which is connected to an electrical encoder (e.g., as shown in FIG. 4A). The electrical encoder generates a signal in response to sensed rotation of the adjustment knob 11, which may be used by the electronic control system to generate commands to activate the electronic actuator 1 to move the pivoting resistance brake assembly 2 closer or further away from the flywheel 5.

A load cell 13 measures the reaction force transmitted from a second part 14 of the pivoting brake assembly (including a magnet holding bracket and one or more magnets held therein) to the first part 7 mounted to the frame. In various embodiments, the load cell 13 may have metal body and be comprised of bonded metal foil strain gauges, silicon strain gauges, and/or other components. The load cell 13 joins the first part of the brake assembly 7 to the second part of the brake assembly 14. In one embodiment, the brake assembly 14 is supported by the load cell 13 and is not supported by other devices or assemblies.

The configuration of the magnet holding bracket 14 and the load cell 13 will be such that the force measured by the load cell 13 will be proportional to the load being applied to the flywheel 5. In order to calculate the torque applied to the user, the product of the applied force, and the distance from the center of the flywheel will yield the torque applied to the flywheel. The rotational speed of the flywheel may also be measured as known in the art (e.g., using one or more sensors to measure RPMs). The power absorbed by the resistance apparatus is then given by the formula Power(W) =Shaft Torque (N*m)*Speed (RPM)*0.10472.

Referring to FIGS. 4A-G, additional embodiments of a braking system for an exercise apparatus will now be described. In the illustrated embodiment, the braking system 20 is provided for an exercise cycle that includes a torque sensing apparatus that can reduce the adjustment effort and shorten the sensing time, thereby increasing the convenience of the operation for the user.

The braking system 20 includes a torque adjusting unit 30 and a linkage assembly, such as load cell 40 in the illustrated embodiment. The torque adjusting unit 30 includes an adjusting bracket 31, an adjusting shaft 34, and a brake compression spring 35. In some embodiments, the brake compression spring 35 is provided to bias the adjusting shaft 34 in an upward position (no resistance on flywheel) absent downward force applied to the adjusting shaft 34.

The adjusting bracket 31 is disposed around a periphery of a flywheel 14, with one end of the adjusting bracket 31 attached to load cell 40. The adjusting shaft 34 (in some embodiments, a push rod having a push rod tip 36), passes through a brake encoder 37, which senses the rotation of the adjusting shaft 34. The push rod tip 36 includes an end portion adapted to correspondingly engage with a portion of brake pad assembly 50. In some embodiments, a joint is formed between push rod tip 36 and the brake pad assembly 50 housing. In the illustrated embodiment, the push rod tip 36 is substantially conical shaped with a rounded tip to engage a corresponding concave portion of the brake pad assembly 50 housing, allowing the push rod to apply downward pressure on the brake pad assembly 50, which pivotably rotates to the fly wheel 14. In various embodiments, the push rod tip 36 and the brake pad assembly 50 housing may be correspondingly formed in other configurations that enable the push rod tip 36 to pivotably move the brake pad assembly 50 towards the flywheel 14.

In one or more embodiments, a brake pad 64 is disposed in the adjusting bracket 31 to apply additional resistance to the flywheel 14 when the adjusting bracket 31 is pushed down onto the flywheel 14 by the adjusting shaft 34. In various embodiments, the adjusting bracket includes a brake pad disposed to apply a resistance to the flywheel when the adjusting bracket is pushed into the flywheel 14 by the adjusting shaft 34. A knob, handle, lever or other mechanism may be disposed at an end of the adjusting shaft 34 to facilitate the application of force to lower the brake pad assembly 50 to contact the flywheel 14.

The load cell 40 is connected on a first end to the adjusting bracket 31 and on a second end to a first mounting bracket 60. An actuator, such as stepper motor 70, is pivotably attached between the first mounting bracket 60 and a second mounting bracket 62. The stepper motor 70 includes a stepper motor rod 72 that is pivotably attached to a brake mounting bracket 74. In operation, the stepper motor 72 is driven to move up and down along the stepper motor rod 72. At the same time, the mounting brackets 60 and 62 move up and down, causing corresponding movement of the adjusting bracket 31 relative to the flywheel 14, such that magnetic flux between one or more pairs of magnetic members 32 disposed on opposite sides of the flywheel is changed, providing resistance to the flywheel 14. When the stepper motor 74 is driven, the mounting brackets 60 and 62 and the load cell 40 adjust accordingly. The torque adjustment unit 30 is driven to orient toward or away from the brake mounting bracket 74 such that a distance and orientation between the stepper motor 70 and the brake mounting bracket 74 is changed, as may be sensed by the load cell 40.

In view of the foregoing, it will be appreciated that the braking system 10 of the present embodiment includes a load cell 40 mounted to support and move the adjusting bracket 31 in response to the stepper motor 70 to provide resistance to the flywheel 14. In some embodiments, the mounting brackets 60 and 62 are pivotably attached to a bike frame. In the illustrated embodiment, the mounting brackets 60 and 62 are pivotably attached to the bike frame through a bike frame weldment 63, in an assembly that may include one or more screws, bolts and/or spacers to center the brake assembly over the flywheel and allow for pivoting of the brake assembly up and down relative to the flywheel.

In one embodiment, a brake mounting bracket pivotably connects the brake pad assembly 50 to the frame at the same pivot point connecting mounting bracket 60 to frame 64. In some embodiments, a torque spring is provided to bias the brake pad assembly 50 upward absent downward force applied by the adjusting shaft 34.

Figure 5A:
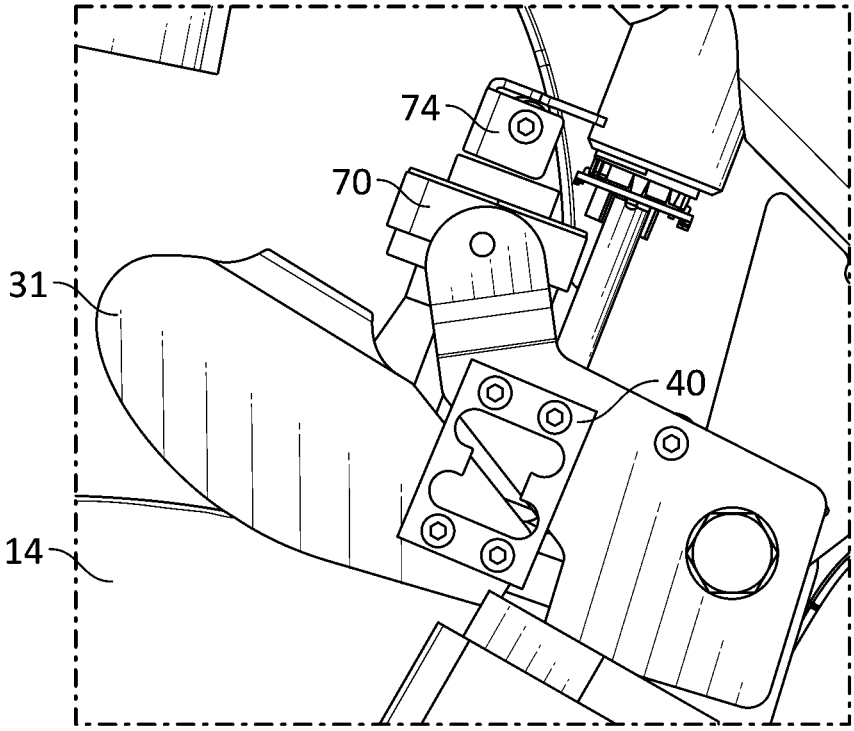
FIGS. 5A and 5B illustrate an operation of a braking system in accordance with one or more embodiments of the present disclosure.
Figure 5B:
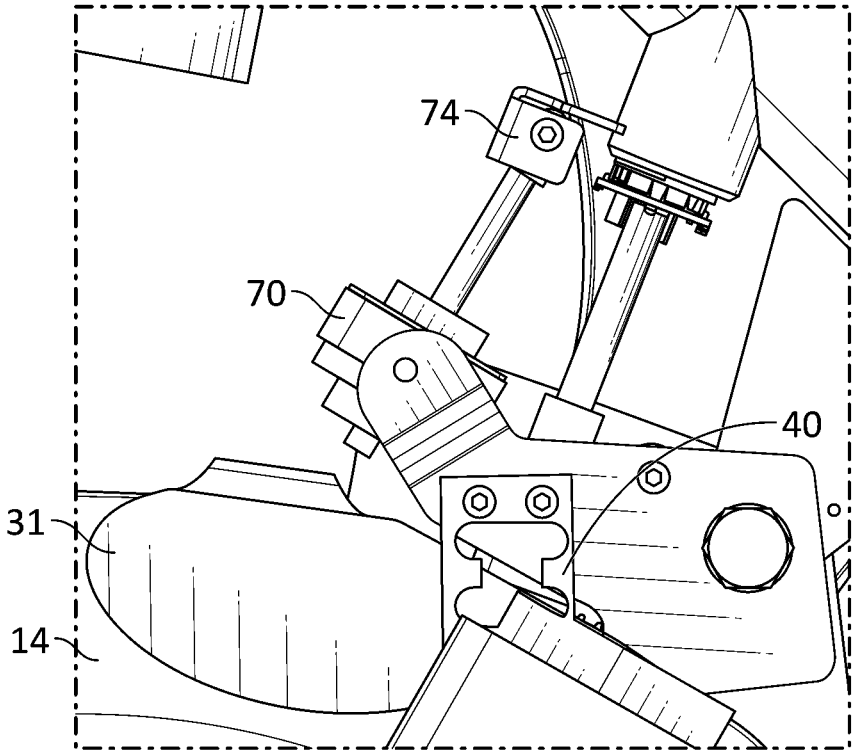

Other embodiments of the present disclosure will now be described with reference to FIG. 5A-D. FIG. 5A illustrates a stepper motor 70 in a first position adjacent to the brake mounting bracket 74. In this first position, the magnets in the adjusting bracket 31 are maintained in a position above the flywheel 14, providing minimal resistance on the flywheel 14. FIG. 5B illustrates the stepper motor 70 in a second position, adjacent to a second end of the stepper motor rod 72. In this second position, the magnets in the adjusting bracket 31 are lowered such that the flywheel is between each corresponding pair of magnets, thereby maximizing magnetic resistance during exercise. The position of the magnets relative to the flywheel 14 is sensed through the load cell 40.

Figure 5C:
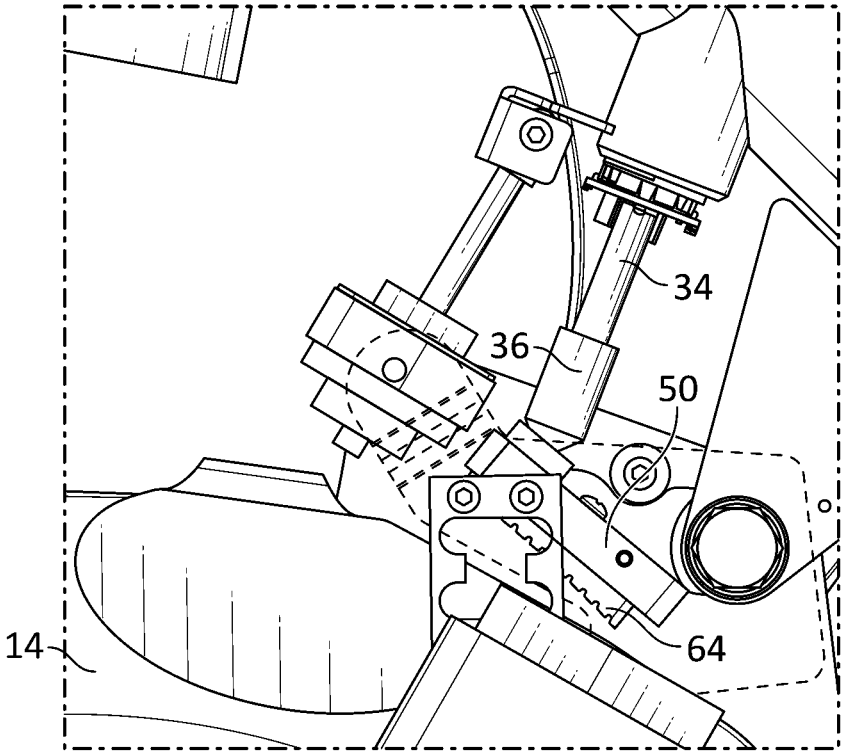
FIGS. 5C and 5D illustrate an operation of an auxiliary braking system in accordance with one or more embodiments of the present disclosure.
Figure 5D:
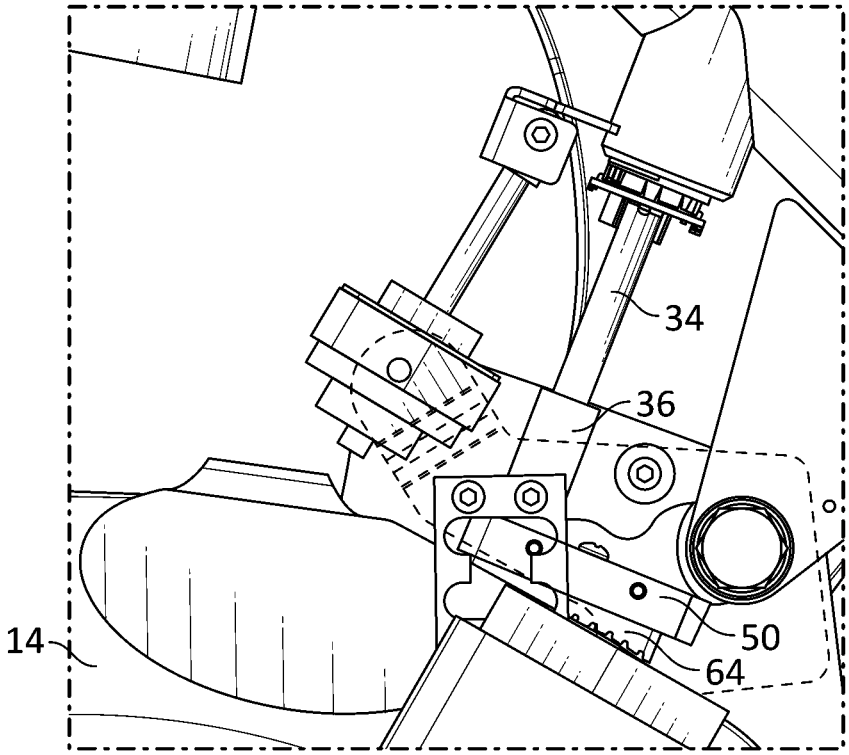

FIG. 5C illustrates the auxiliary brake in a first position, providing no resistance on the flywheel. In the first position, the brake pad assembly 50 is biased away from the flywheel 14. FIG. 5D illustrates the auxiliary brake in second position, with the brake pad 64 pressed against the flywheel 14 through the downward pressure applied by a user on the adjusting shaft 34. It will be appreciated that the operation of the auxiliary brake does not affect the resistance applied by the magnets of the adjusting bracket 31, which is controlled by the stepper motor 70. It will be appreciated that certain advantages are achieved in the disclosure embodiments. For example, a user may be provided with a single knob that may be rotated to control the stepper motor 70 to raise or lower the resistance braking assembly, and that may be depressed to activate an auxiliary brake through a second braking assembly.

The embodiments disclosed herein achieve various design goals, including reducing bike-to-bike watt variability (and metrics accuracy) and providing accurate calibration for a simple and easy way for the user to accurately adjust the resistance during exercise. In various embodiments, a braking mechanism may include a resistance control system comprising a user-controlled adjustment knob and a brake encoder for sensing the user knob adjustments. The sensed knob adjustments may be translated into signals for driving an electric actuator to vary the resistance. In various embodiments, accuracy will approach and/or exceed+/−1%.

In various embodiments, the actuator may include a stepper motor operable to selectively drive the brake assembly towards and away from the flywheel, with speed and precision exceeding human control. In this manner, the user is provided with fully programmatic control of brake level.

In some embodiments, the braking force is measured via a load cell, which may include a low cost, high precision load cell operable to measure forces generated directly within the brake mechanism. Braking force can be used with a measured flywheel speed to accurately calculate user power output. In one embodiment, the actuator may comprise a 35 mm permanent magnet, non-captive, linear stepper motor to actuate the braking mechanism. In various embodiments, the load cell may include a low-cost aluminum, single point load cell, arranged such that the load cell is the only member connecting the magnet holding bracket to the rest of the braking mechanism. The stepper motor may include an integrated stepper driver with current control. In some embodiments, a stepper motor operable at 12 v, 500-900 mA may be used. Microstepping may be used for smooth and quiet operation.

In some embodiments, the signal from the load cell may be conditioned via integrated amplifiers and high-resolution analog-to-digital converters (ADCs) compatible for load cell amplification. Alternatively, a standalone amplifier could be used in conjunction with a built in ADC on a microcontroller. Alternatively, the load cells may include conditioning circuitry and provide a digital output.

Figure 6A:
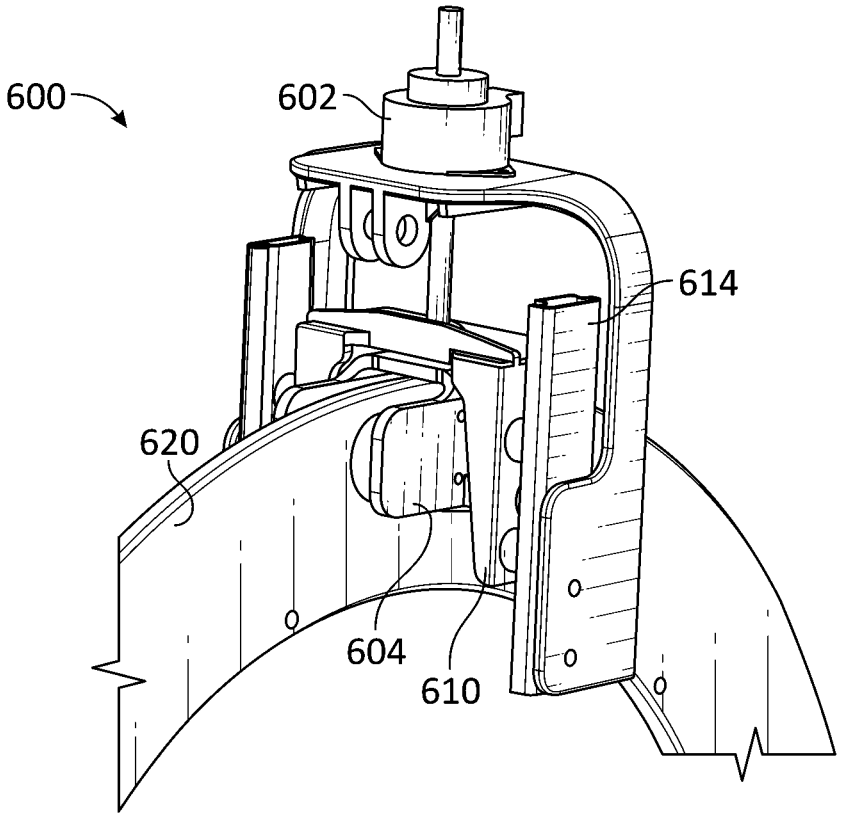
FIGS. 6A and 6B illustrate a braking system in accordance with one or more embodiments of the present disclosure.
Figure 6B:
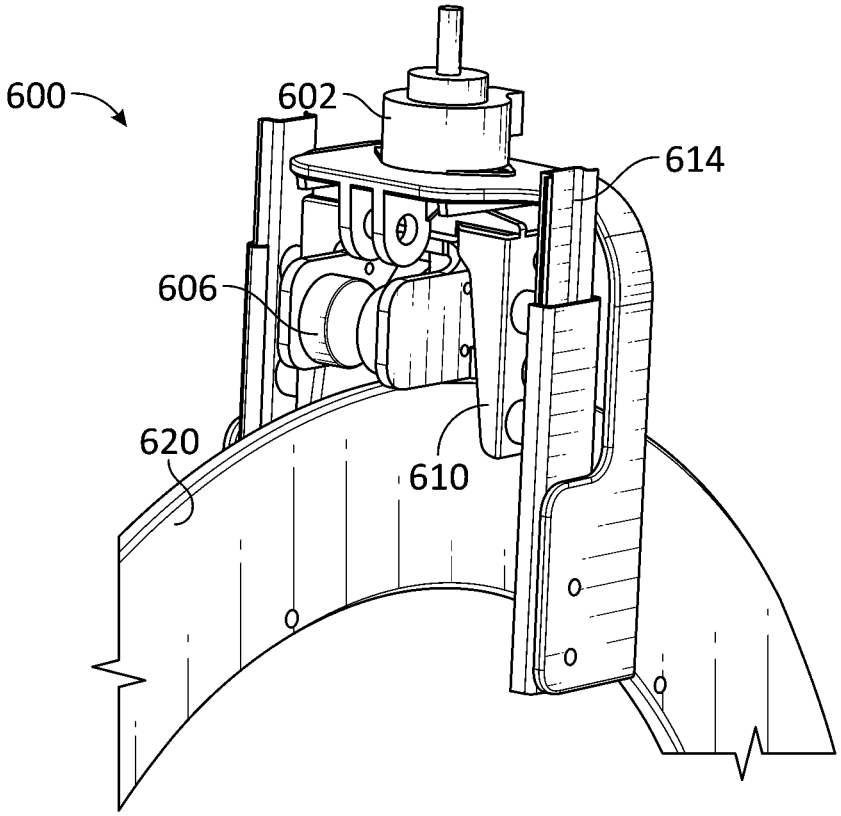

In some embodiments, the resistance magnets may include 6 resistance magnets arranged in 3 corresponding magnet pairs (or other paired arrangement). Each magnet may be, for example, 25 mm diameter, 8 mm thick sintered Neodymium rare earth magnets, grade N32. The resistance apparatus may include a magnet holder that is formed in one piece, machined and bent into shape for use as described herein. In some embodiments, two opposing linear bearings carry the measurement subassembly and common drawer slides or linear bearings with a similar envelope could be used. FIGS. 6A-B illustrate an alternate embodiment of a brake mechanism 600 in a first position (FIG. 6A) providing resistance to the flywheel 620 and a second position (FIG. 6B) with the magnets maintained in a position above the flywheel 620, providing minimal resistance on the flywheel 620. The brake mechanism 600 includes an actuator 602, a bracket 604, magnet brake components 606 disposed on the bracket 604, a load cell (not shown) disposed between the bracket and a mounting bracket 610, which is slidably mounted to drawer slides 614.

In various embodiments, the auxiliary (e.g., emergency brake) may be activated via a cable, plunger or other mechanical system. By integrating the emergency brake into the resistance apparatus, the cycle has a cleaner look without an extra activation interface.

Various embodiments of electrical components for use in an exercise apparatus with a braking system disclosed herein will now be described with reference to FIG. 7. In various embodiments, logical components are operable to evaluate the load cell signals and adjust for noise, accuracy, precision, resolution and drift throughout a workout. The logical components may include a calibration procedure, power calculation method, reporting of data to a display, tablet or other connected device, and/or other features associated with the operation of the exercise apparatus. The logical components may also function to evaluate and tune the actuator assembly motion, accuracy, speed and audible noise. In some embodiments, communication with a tablet or display may be facilitated (e.g., using RS-232 standard). The logical components may include a "go to resistance" option directing the stepping motor/actuator to adjust the resistance until a desired resistance is sensed.

Figure 7:
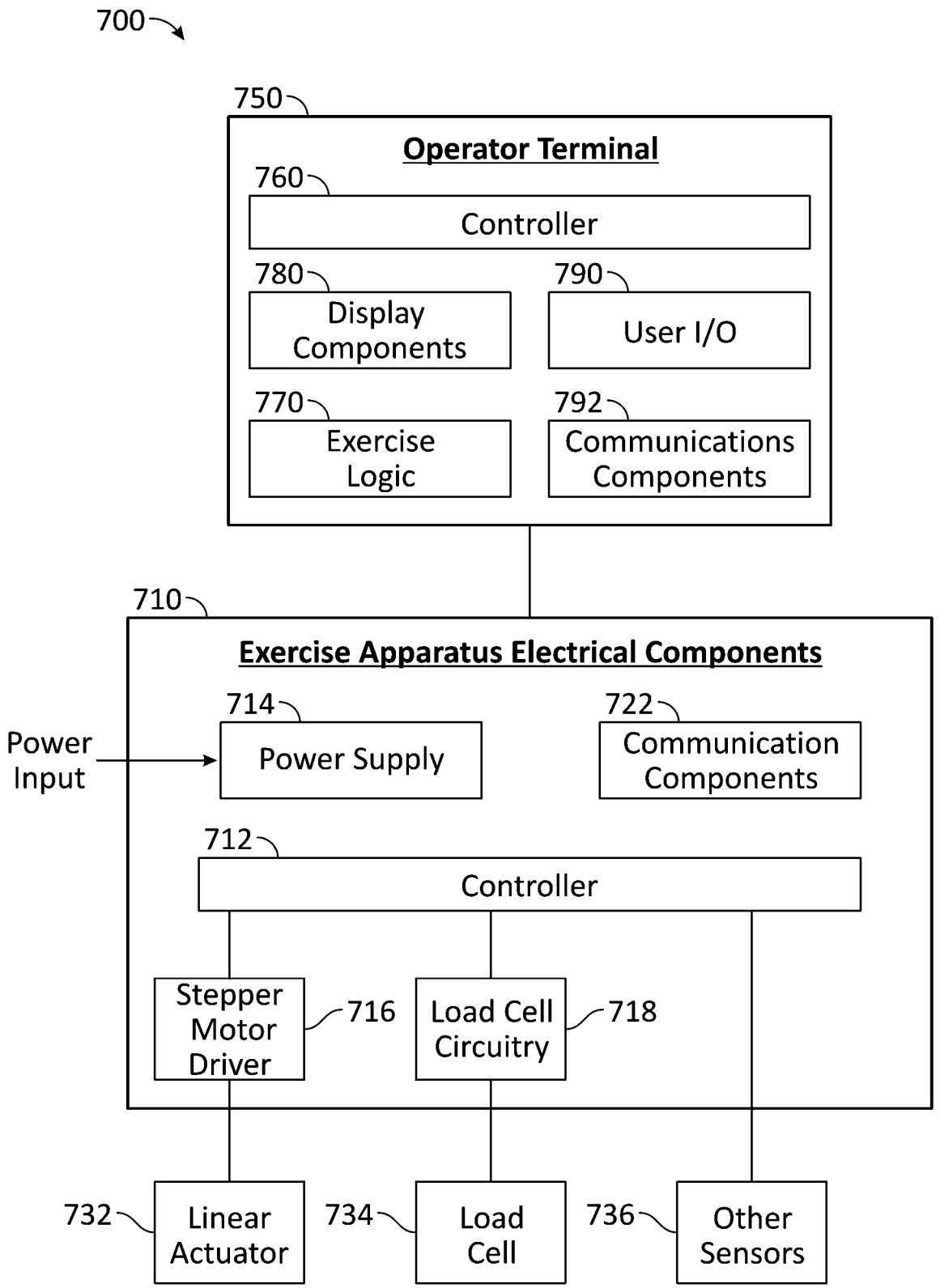
FIG. 7 is a block diagram illustrating electrical components for use in an exercise apparatus implementing a braking system in accordance with one or more embodiments of the present disclosure.

FIG. 7 illustrates electrical and processing components for an example exercise apparatus in accordance with various embodiments of the present disclosure. A system 700 includes exercise apparatus electrical components 710 and an operator terminal 750. The exercise apparatus electrical components 710 facilitate the operation of an exercise apparatus, including communications with the operator terminal 750, controlling various components (e.g., a linear actuator), and receiving and processing sensor data.

In various embodiments, the exercise apparatus electrical components 710 include a controller 712, power supply 714, communications components 722, a stepper motor driver 716 for controlling the linear actuator 732, load cell circuitry 718 (e.g., PGA and/or ADC) for receiving a signal from load cell 734 and conditioning the signal, and interfaces with other sensors 736, which may include sensors for detecting flywheel RPMs and/or sensors for measuring changes in knob positon in response to user adjustments as disclosed herein.

The controller 712 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), or other processing devices used to control the operations of the exercise apparatus.

Communications components may include wired and wireless interfaces. Wired interfaces may include communications links with the operator terminal 750, and may be implemented as one or more physical network or device connect interfaces. Wireless interfaces may be implemented as one or more WiFi, Bluetooth, cellular, infrared, radio, and/or other types of network interfaces for wireless communications, and may facilitate communications with the operator terminal, and other wireless devices. In various embodiments, the controller 712 is operable to provide control signals and communications with the operator terminal 750.

The operator terminal 750 is operable to communicate with and control the operation of the exercise apparatus electrical components 710 in response to user input. The operator terminal 750 includes a controller 760, exercise and user control logic 770, display components 780, user input/output components 790, and communications components 792.

The processor 760 may be implemented as one or more microprocessors, microcontrollers, application specific integrated circuits (ASICs), programmable logic devices (PLDs) (e.g., field programmable gate arrays (FPGAs), complex programmable logic devices (CPLDs), field programmable systems on a chip (FPSCs), or other types of programmable devices), or other processing devices used to control the operator terminal. In this regard, processor 760 may execute machine readable instructions (e.g., software, firmware, or other instructions) stored in a memory.

Exercise logic 770 may be implemented as circuitry and/or a machine readable medium storing various machine readable instructions and data. For example, in some embodiments, exercise logic 770 may store an operating system and one or more applications as machine readable instructions that may be read and executed by controller 760 to perform various operations described herein. In some embodiments, exercise logic 770 may be implemented as non-volatile memory (e.g., flash memory, hard drive, solid state drive, or other non-transitory machine readable mediums), volatile memory, or combinations thereof. The exercise logic 770 may include status, configuration and control features which may include various control features disclosed herein.

Communications components 792 may include wired and wireless interfaces. A wired interface may be implemented as one or more physical network or device connection interfaces (e.g., Ethernet, and/or other protocols) configured to connect the operator terminal 750 with the exercise apparatus electrical components 710. Wireless interfaces may be implemented as one or more WiFi, Bluetooth, cellular, infrared, radio, and/or other types of network interfaces for wireless communications.

Display 780 presents information to the user of operator terminal 750. In various embodiments, display 780 may be implemented as an LED display, a liquid crystal display (LCD), an organic light emitting diode (OLED) display, and/or any other appropriate display. User input/output components 790 receive user input to operate features of the operator terminal 750.

Figure 8:
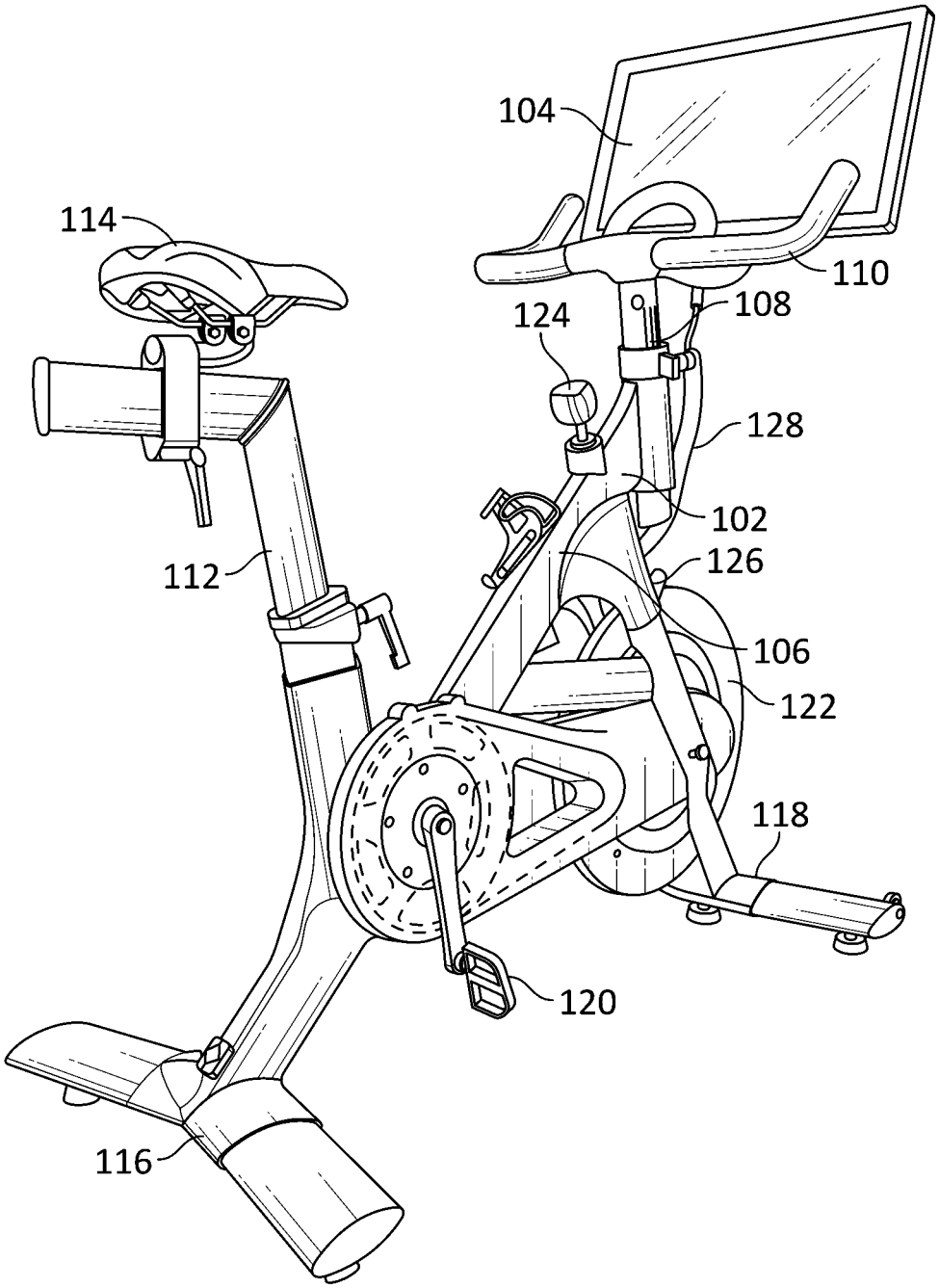
FIG. 8 illustrates an exercise apparatus implementing a braking system in accordance with one or more embodiments of the present disclosure.

Referring FIG. 8, an exemplary exercise apparatus is shown including an embodiment of the braking system disclosed herein. As shown, a stationary bike 102 includes integrated or connected digital hardware including at least one display screen 104.

In various exemplary embodiments, a stationary bike 102 may comprise a frame 106, a handlebar post 108 to support the handlebars 110, a seat post 112 to support the seat 114, a rear support 116 and a front support 118. Pedals 120 are used to drive a flywheel 122 via a belt, chain, or other drive mechanism. The flywheel 122 may be a heavy metal disc or other appropriate mechanism. In various exemplary embodiments, the force on the pedals necessary to spin the flywheel 122 can be adjusted using a resistance adjustment knob 124 which adjusts a resistance mechanism 126, such as the braking system disclosed herein. The resistance adjustment knob may rotate an adjustment shaft to control the resistance mechanism 126 to increase or decrease the resistance of the flywheel 122 to rotation. For example, rotating the resistance adjustment knob clockwise may cause a set of magnets of the resistance mechanism 126 to move relative to the flywheel 122, increasing its resistance to rotation and increasing the force that the user must apply to the pedals 120 to make the flywheel 122 spin.

The stationary bike 102 may also include various features that allow for adjustment of the position of the seat 114, handlebars 110, etc. In various exemplary embodiments, a display screen 104 may be mounted in front of the user forward of the handlebars. Such display screen may include a hinge or other mechanism to allow for adjustment of the position or orientation of the display screen relative to the rider.

The digital hardware associated with the stationary bike 102 may be connected to or integrated with the stationary bike 102, or it may be located remotely and wirelessly connected to the stationary bike. The digital hardware may be integrated with a display screen 104 which may be attached to the stationary bike or it may be mounted separately but should be positioned to be in the line of sight of a person using the stationary bike. The digital hardware may include digital storage, processing, and communications hardware, software, and/or one or more media input/output devices such as display screens, cameras, microphones, keyboards, touchscreens, headsets, and/or audio speakers. In various exemplary embodiments these components may be integrated with the stationary bike. All communications between and among such components may be multichannel, multi-directional, and wireless or wired, using any appropriate protocol or technology. In various exemplary embodiments, the system may include associated mobile and web-based application programs that provide access to account, performance, and other relevant information to users from local or remote personal computers, laptops, mobile devices, or any other digital device.

In various exemplary embodiments, the stationary bike 102 is equipped with various sensors that can measure a range of performance metrics from both the stationary bike and the rider, instantaneously and/or over time. For example, the resistance mechanism 126 may include sensors providing resistance feedback on the position of the resistance mechanism. The stationary bike may also include power measurement sensors such as magnetic resistance power measurement sensors or an eddy current power monitoring system that provides continuous power measurement during use. The stationary bike may also include a wide range of other sensors to measure speed, pedal cadence, flywheel rotational speed, etc. The stationary bike may also include sensors to measure rider heart-rate, respiration, hydration, or any other physical characteristic. Such sensors may communicate with storage and processing systems on the bike, nearby, or at a remote location, using wired (such as view wired connection 128) or wireless connections.

Hardware and software within the sensors or in a separate processing system may be provided to calculate and store a wide range of status and performance information. Relevant performance metrics that may be measured or calculated include resistance, distance, speed, power, total work, pedal cadence, heart rate, respiration, hydration, calorie burn, and/or any custom performance scores that may be developed. Where appropriate, such performance metrics can be calculated as current/instantaneous values, maximum, minimum, average, or total over time, or using any other statistical analysis. Trends can also be determined, stored, and displayed to the user, the instructor, and/or other users. A user interface may be provided for the user to control the language, units, and other characteristics for the information displayed.

Figure 9:
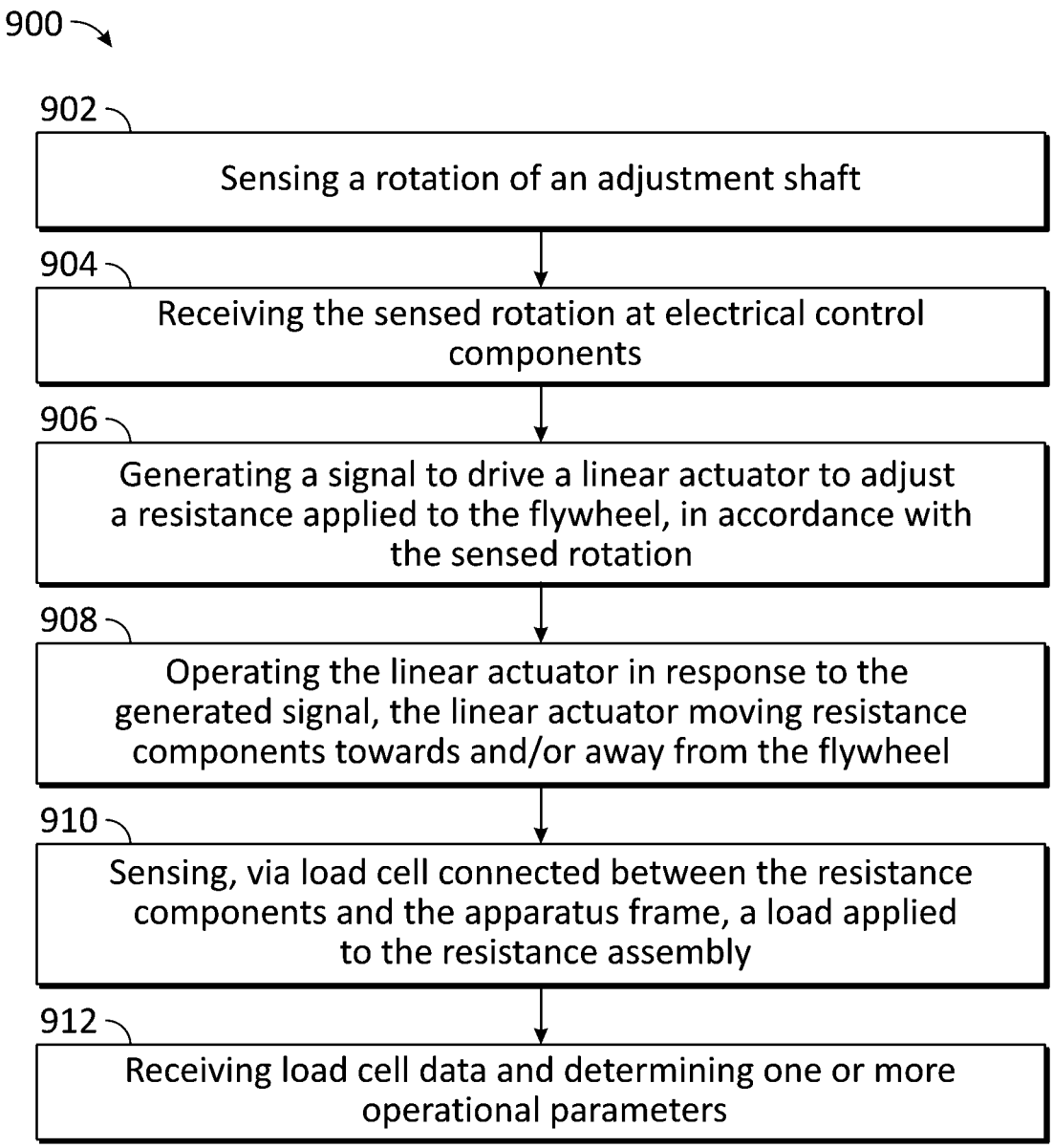
FIG. 9 illustrates a method of operating a braking system in accordance with one or more embodiments of the present disclosure.

Referring to FIG. 9, a process 900 for operating a braking system in accordance with embodiments of the present disclosure will now be described. In step 902, a rotation of an adjustment shaft is sensed using a brake encoder and received by the electrical control components (step 904). In accordance with the sensed rotation, the electrical control components generate a signal to drive a linear actuator to adjust the resistance applied to the flywheel (step 906). The linear actuator is then operated in response to the generated signal, to vary resistance by moving resistance components towards and/or away from the flywheel (step 908). A load cell is connected between the resistance components and the frame and senses a load applied to the resistance assembly. The load cell data is received by the electrical control components and one or more operational parameters is determined (step 912), such as instantaneous power or a measure of resistance applied to flywheel.

Example Implementation

An example brake implementation in accordance with one or more embodiments will now be described with reference to FIGS. 10-13. The illustrated embodiments provide example criteria for the brake, encoder and for deriving values for power, cadence and resistance, which may be displayed to the user. The data may be stored in a central server, such as a cloud storage service.

Figure 10:
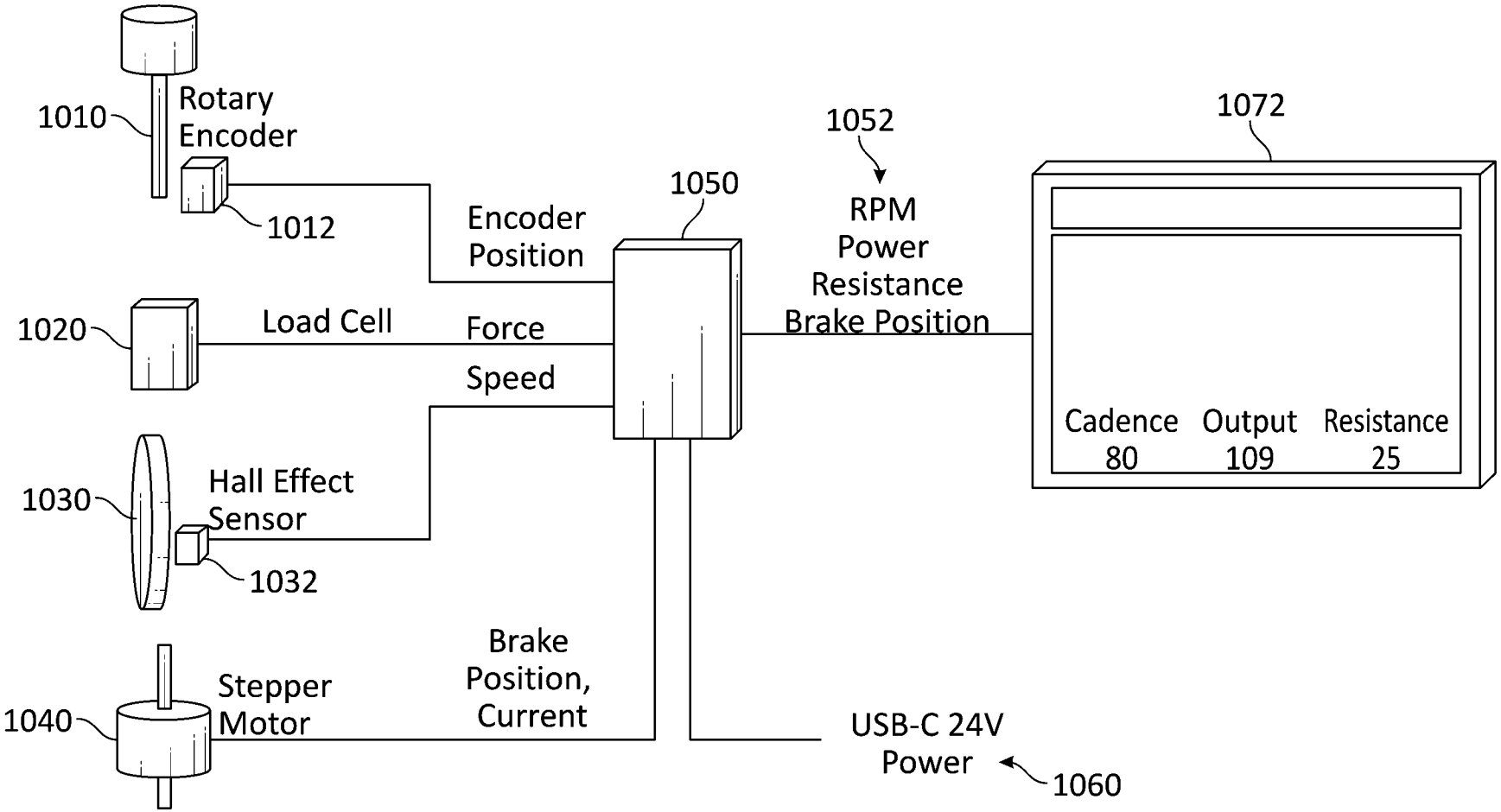
FIG. 10 illustrates an example system for measuring cadence and/or resistance in an exercise apparatus in accordance with one or more embodiments of the present disclosure.

FIG. 10 illustrates an example system, in accordance with one or more embodiments of the present disclosure. A processing system 1000 includes a control unit 1050 configured to receive and process signals from a plurality of sensors and/or components of an exercise apparatus and facilitate communications between components and a computing device. In the illustrated embodiment, the control unit 1050 is electrically connected to a rotary encoder 1012, which is configured to sense rotation of a brake adjustment shaft 1010, a load cell 1020 configured to measure the force being applied to the flywheel by a magnetic braking assembly, a hall effect sensor 1032, which may be disposed to track rotation of a flywheel 1030 (e.g., speed of rotation), and a stepper motor 1040, which provides information regarding a current brake position.

The control unit 1050 may be connected to other devices through a communications link 1060 (e.g., USB-C connection providing 24V power to the control unit). The control unit 1050 processes the sensor inputs to generate data 1052 for display to the user (e.g., through a display device 1072), such as revolutions per minute (RPMs), power, resistance and brake position. In various embodiments, the control unit 1050 may be implemented as circuitry providing an interface between the sensors and a processing system, a sensor board, a data logger, a computing device and/or other hardware and/or software configured in accordance with system requirements.

FIG. 11 illustrates example power states for efficient operation of an exercise apparatus, such as system 100 of FIG. 10. The power states 1100 include production system states, state transitions and mapping to subsystem states including a touch display/tablet, brake controller and other system components. In the NO POWER state 1110, the system is not receiving power (e.g., not connected to a wall power outlet) and all components are off. When the system is connected to a power source, the system enters an OFF state 1120. This is a lower power state (e.g., consuming less than 0.5 W) and no processing is performed. A light (e.g., a LED) may be powered on to indicate to the user that power is being received. If the system is turned on (e.g., by pressing a button on a tablet, tapping a touchscreen display, or other user input), then the system enters an AWAKE state 1130 for full operation of the system and exercise apparatus. The system may enter a SLEEP mode 1150 in response to user input (e.g., pressing button on tablet) or the system being idle for a period of time. The user may exit the SLEEP mode 1150 by pressing a control on the tablet or providing other input detected by the system. An AWAKE (DSP OFF) state 1140 provides background processing such as system updates, data processing, data communications with other devices, while appearing to the user to be in a sleep mode (e.g., tablet display is turned off).

RPM

Referring back to FIG. 10, the sensor input processing will now be described, in accordance with various embodiments. Data from the hall sensor 1032 is used to calculate the RPMs of the exercise apparatus during operation. The system may calculate the cadence using the hall effect sensor input located on the flywheel. The hall sensor 1032 may be disposed in a fixed position on the exercise apparatus to sense a magnet on the flywheel 1030 with each revolution of the flywheel. The sample rate may be interrupt driven and may represent crank RPM which is proportional to the flywheel RPM. In one implementation the crank RPM is calculated by dividing the flywheel RPM by a constant (e.g., 4.395 in an example implementation). An interrupt routine is attached to the falling edge of the hall effect sensor input. The routine may calculate and update variables that represent flywheel rpm, crank rpm, and/or other rate information specific to the exercise apparatus. The routine may incorporate a debouncing method to reject false triggering if two or more falling edges are detected on one passing of the magnet. The system may also be configured to reject interrupts that would produce clearly erroneous data (e.g., a RPM that is above a predetermined threshold). The routine may further incorporate a process to decay the measured RPM to zero in a natural way if flywheel comes to an abrupt stop.

Load Cell

In some embodiments the load cell 1020 operates at a predetermined sample rate (e.g., 4 Hz) and measures the force being applied to the flywheel (e.g., in decagrams or a similar measurement unit) by the magnetic braking assembly. The control unit 1050 communicates with the load cell 1020 using a standard protocol such as $I^2C$. The force measurements from the load cell 1020 are used to calculate power. For example, power may be calculated as a function of the force derived from the load cell 1020 and the speed (or other rate calculation) of the flywheel calculated from the RPM data.

In some embodiments, the control unit 1050 and/or tablet/display 1072 includes a load cell calibration routine. The routine creates a table of load cell measurement values at equally spaced positions of the brake (e.g., 10 locations) while the flywheel is still. This data allows for "zeroing" of the load cell without moving the brake to a 'home' position. The routine includes touching the edge of the flywheel to get accurate position data. The offset table may be stored in non-volatile memory including a crc checksum to ensure data integrity.

Upon power-up the computing system (e.g., the tablet, control unit or other processing device) checks for a valid load cell table in memory. If a table exists, then a standard homing procedure is conducted. If a valid table is not found in memory, then the calibration routine is executed to build a new table and store the new table in memory. Using the table, a current load cell reading can be used to calculate a position/offset by interpolating from the position information from the table.

In some embodiments, load cell zeroing is performed at or near the beginning of an exercise session. As is common with load measuring devices, the reading from the load cell 1032 can drift over time based on many factors that cannot be controlled. A routine may be performed to generate an "offset" which may be added to future readings from the load cell 1032, or until the next time the load cell is zeroed. In order to allow zeroing at any brake position, the offset table is used to calculate the offset to apply. For example, a formula to calculate "offset" is the current reading plus an interpolation of output from position from the table. The procedure described herein may be executed in approximately 1 second or less and may be performed automatically within the sensor firmware. In some configuration, the procedure is performed before every ride. The firmware may wake up and take the reading on regular intervals (e.g., every few minutes), for example, as determined by the permissible power draw. Motion of the flywheel may result in inaccurate readings. Thus, if the flywheel is moving upon wake (e.g., >10 RPMs), the last recorded value may be used if it is not too old (e.g., not older than 10 minutes).

Knob Position

The position of the adjustable shaft (e.g., knob position) is sampled at a rate through interrupts and may be measured in terms of rotations by the rotary encoder 1012. The knob position may be calculated and tracked using components of the rotary encoder 1012.

Stepper Motor Drive

The stepper motor 1040 is configured to operate from an integrated circuit or other control components to initialize, configure and drive the stepper motor to provide positional control of the brake. A homing process is performed on the stepper motor through an initial startup routine. As previously discussed, the stepper motor position is used to populate an offset table of position values and load cell measurement values.

A homing routine may be performed on every power cycle (e.g., unplug/replug a power source). The homing routine may touch the brake mechanism to the edge of the flywheel to achieve homing. In some embodiments, homing is achieved using integrated stall detection within the stepper driver. An open loop position control routine may be provided to keep track of the brake position vs. the zero position. The homing routine may be used to determine the upper and lower limit of the range of motion of the brake. Stepper motor position may be counted as steps up and away from contact between the magnet holder and the edge of the flywheel. In some embodiments, logic is provided to detect motion of the flywheel and prevent the homing routine from executing if motion of the flywheel is detected from the hall effect sensor. In this case, the user may be notified to stop pedaling while the homing routine is executed. In some implementations, the homing routines disclosed herein may be completed in approximately five seconds or less.

The stepper motor 1040 position is used to determine a location value of the brake assembly in units of full steps. For example, a scale of 0 to 1000 steps may be used, where 1000 is when the brake contacts the flywheel and 0 is near the top of the range of the travel during operation. The stepper motor 1040 is configured to operate between positions 0 and a value that is less than 1000 (e.g., 750) to avoid contact with the flywheel and to match an operational range of the exercise apparatus.

In one or more embodiments, a computing system (e.g., the tablet/display 1072), resistance controller, control unit or other device/circuitry is configured to provide instructions to a stepper motor 1040, including generating a "Drive to Position" command. For example, when a resistance setting is desired (e.g., as set by a user or controlled by the exercise apparatus in accordance with a terrain feature) a corresponding position is determined and a drive to position command is issued. The stepper motor 1040 is configured to receive the "Drive to Position" command, including the desired position value, and command the stepper mover to execute a corresponding number of steps between a current position and the target position. The resistance may be converted into a position using a reverse lookup from the offset table. The command should then be used to drive to position using a smooth motion control profile for a desirable user experience.

The encoder is configured to update the resistance setpoint (e.g., according to a fixed linear ratio of 7.5 revolutions per 100 resistance percentage points). In one embodiment, upon startup the firmware does not cause any offset to the resistance setpoint based on relative knob position. In this embodiment, the knob acts as an incremental encoder with no zero reference. Upon moving the encoder updates the resistance setpoint according to the defined ratio. The encoder movement logic may be configured to reject small inputs (e.g., changes under 1-degree) to avoid movement when users place their hand on the knob.

In some embodiments, acceleration, speed and current position value of the stepper motor is managed by a stepper supervisor to achieve synchronous stepping under various speed and load conditions and protect the stepper motor from overheating in the event the user cycles the stepper continuously at high load for a long time. Tuning acceleration and running speeds and custom current profiles of the stepper facilitates a user experience that feels smooth. Operation of the stepper motor may further include protection circuitry and/or control logic to provide thermal protection for the stepper motor.

Power

In various embodiments, the power calculated and displayed on the tablet/display 1072 is calculated using a polynomial equation and matching coefficients with variables. For example, the power calculation uses readings of position value of resistance apparatus and RPMs of flywheel. To calculate power, the system can sum of all terms of an element-wise multiplication of the two lists of values. In the event the sensor data is invalid, the power value can be provided based on a fallback power map based on resistance and RPM only.

Resistance

Operation of an exercise apparatus with resistance correction mechanics will now be described with reference to FIG. 12. In a default configuration, resistance is displayed to the user corresponding to the position at which the brake is currently located. This is done using a lookup table corresponding brake position to a resistance value. A reverse lookup is used when the processing system provides instructions to the stepper motor to drive to a particular resistance/position. The user interface can be configured to show the target resistance value (e.g., the resistance setpoint) and provide an indication (e.g., display flashing value) until the current resistance value matches.

An exercise apparatus 1210 including a braking system disclosed herein includes an interactive display. As the user rides the exercise apparatus 1210, the resistance is displayed to the user (step 1220) based on a mapping of brake position to resistance, as illustrated in table 1230. At the same time, values are checked against a fixed map 1240 and an error value is calculated in step 1222. In step 1264, the errors values are stored in a new error map 1260. The display table 1230 then gets updated in step 1262. The resulting resistance value is displayed for the user as shown in screen shot 1270.

Figure 12:
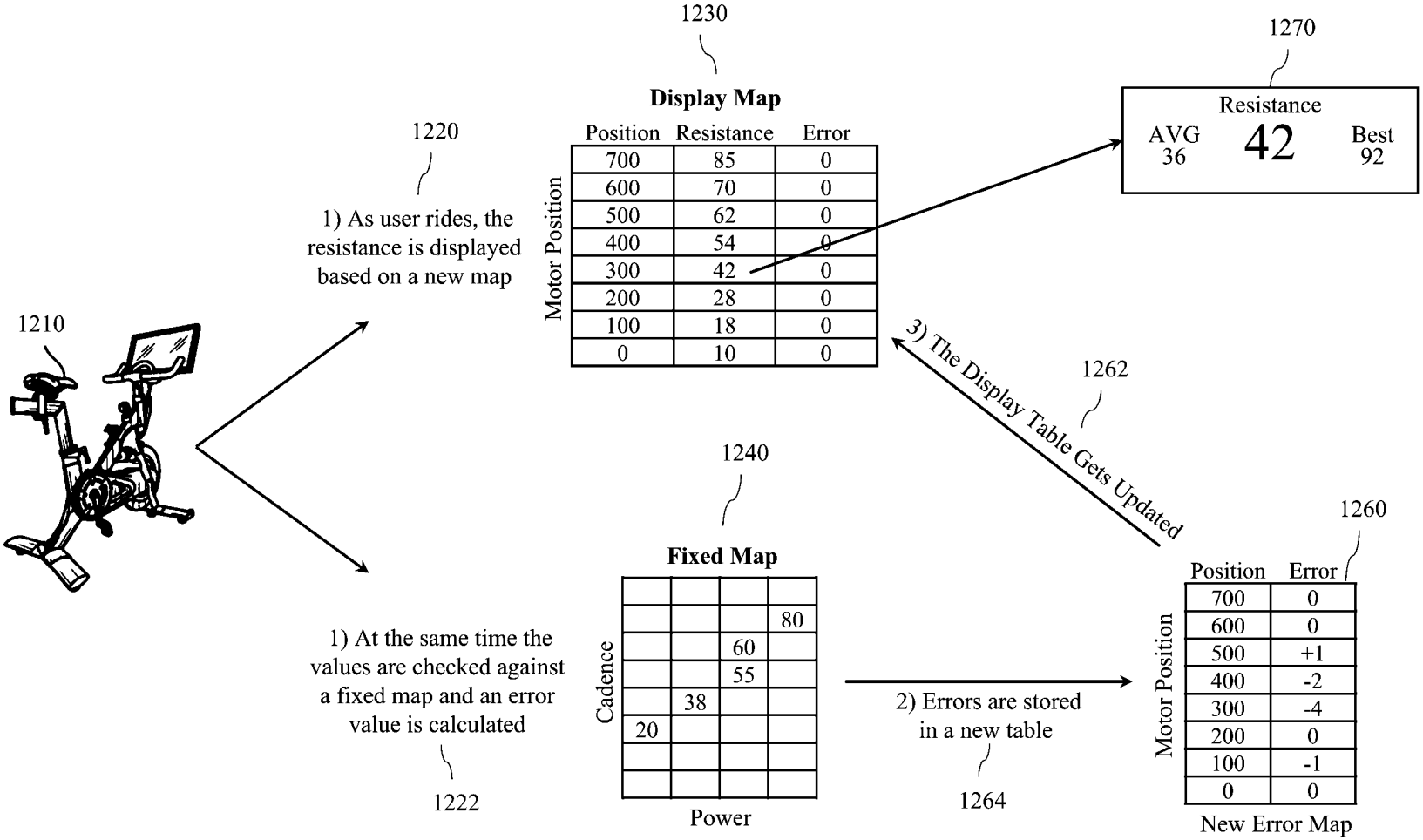
FIG. 12 illustrates example resistance correction mechanics for an exercise apparatus in accordance with one or more embodiments of the present disclosure.

As illustrated, the procedure of FIG. 12 may be implemented to eliminate bike to bike variability in power output for given cadence/resistance pairs (e.g., when an older bike is replaced with a newer bike in accordance with the present disclosure or when data from different types of bikes is shared/compared in a larger system). In one embodiment, the position table is updated through the auto correction procedure of FIG. 12, which can occur once per minute and only after the knob is turned the at least 5 percentage points, for example.

The resistance determination uses the two tables, which may be referred to as (i) the active resistance and position table (e.g., table 1230), and (ii) a static, ideal, power/resistance/cadence model that is very closely matched to a reference bike or a lookup table (e.g., fixed table 1240), which will be used to calculate an error signal. Because the actual map may be large, a model of that relationship can be used in its place. The same model can be used, for example, across bikes of a certain brand.

Resistance auto-correction is achieved using the procedure of FIG. 12. During initial operation and for normal operation, the relationship between resistance and brake position is stored in the resistance and position table 1230. For driving to a brake position from a resistance setpoint, or for reporting a current resistance value from a current position value, the lookup table serves as the method to transform between the two. During use, an error signal is generated and kept track of using a running average technique. The error signal is the difference between the resistance generated from the current lookup table, and one that is found using the static, ideal table of power/resistance/cadence combos of table 1240.

The error is calculated periodically (e.g., once per second). In some embodiments, error is not calculated if the acceleration of the flywheel is above a threshold (e.g., 3 revolutions/minute 2), when RPM is less than 20, or when power is less than 22 W. The running average can have various lengths (e.g., 30 values). The length and frequency of the running average can be adjusted to improve performance as desired. When resistance setpoint changes are executed where the commanded change is more than 5 percentage points, the value for the running average of error is used to update the table of resistance to percentage table to zero out the error. If the running average is not yet reached the threshold number of readings (e.g., 30 readings long), no zeroing will take place. If the error signal is greater than 2 percentage points, it can be split up into different moves.

Program logic for implementing the resistance calculation procedure of FIG. 12 includes a function to transform a percentage setpoint (e.g., value of resistance from 0-100%) to a position setpoint. This function suppresses error correction for moves that are larger than a particular number of steps (e.g., 38 full steps) or about 5 percentage points. This function could be called when the system executes a move to a new percentage either from the encoder or from the tablet/display. An example function is illustrated below:

```
def PercentageToPosition(percentage):
  position = lookup_1D(resistance_to_percentage_table, percentage =
percentage)
  If (abs(motor_controller.current_position( )-
position)>=38*microsteps):
  zero_errors(resistance_to_percentage_table,
  running_average_error.current_average( ))
  position = lookup_1D(resistance_to_percentage_table, percentage)
  Return position
```

An example function to handle the cumulative errors built up over time is illustrated below:

```
def zero_errors(table, errors):
#return a table with the position shifted up or down by the specified
number of steps.
#Keeping track of error: this should be run on a regular interval, it could
be nested into the function that updates the power calculation itself.
def calculate_error(Titan_ideal_map, resistance_to_percentage_table,
```

-continued

```
cadence, power,
  position):
  If (derivative(cadence)>threshold):
  If (cadence >= 20 && power >= 22):
  actual_resistance = lookup_2D(Titan_ideal_map, cadence, power)
  actual_position = lookup_1D(resistance_to_percentage_table, position
=
  position)
  error = actual_position − position running_average_error.add(error)
```

Various ranges used in an implementation of the present embodiment (e.g., RPM, W, threshold for determining speed stability, size of the running average, frequency to call the function) may be system dependent and determined experimentally. An initial value of less than 5 rpm/second$^2$ may be used to start. Third, the size of the running average and the frequency to call that function should be determined experimentally.

In various embodiments, the systems disclosed herein may be used to capture diagnostic and other data and transmit the data to an central server, the cloud or other processing system for further processing, which may include tracking data across one or more exercise apparatus. The diagnostic data may be captured and kept up to date in a nonvolatile memory and passed to the tablet/computing device and/or cloud on a periodic basis (e.g., once per wake cycle). The diagnostic data may include: 1. Odometer (in total revolutions); 2. Hours (in minutes); 3. Calibration cycles; 4. Wake cycles; 5. Encoder moves (total number the encoder has been moved); 6. Drive to position moves (total number of tablet directed movements); 7. Average motor position (0-768); 8. Average encoder movement size in terms of motor position (0-768); 9. Maximum encoder movement size in terms of motor position (0-768).

Power/Resistance/Cadence Model

Cadence-resistance-output values used in conventional exercise equipment do not provide accurate readings of power due to inherent manufacturing variations between devices and other factors. The systems disclosed herein include a novel load cell arrangement and a positioning stepper motor that provides improved sensing of the location of the brake and measures the load being applied to the flywheel by the magnetic brake. Load, position, and cadence values from the system are used to calculate the power input by the user. This could be done with the empirical equations for torque and power, and the known geometry and configuration of the load sensor. During development, the coefficients/relationships that define the system may be carefully measured, calibrated and adjusted for accurate results during use.

The system illustrated in FIG. 12 includes a cadence-power model for updating resistance values. A system and method for efficient and accurate simulation/modeling of a power sensor to measure output power on exercise machines (which, for now, is bikes) will now be described. A statistical model can be used in place of the empirical formulas and/or coefficients. This model will predict output power given resistance, cadence, and load.

The method starts by measuring output power generated by a bike at various levels of cadence, resistance, and load, using a high-precision dynameter. This data is collected to a cloud data store. This data is downloaded onto a server/remote/host machine to train an elastic net model (or other statistical model as appropriate) on this data to learn the underlying relationships between output power and the other variables. The elastic net is a linear model that is trained using regularization, a technique that penalizes large model coefficients/weights, which reduces overfitting, and regularization and variable selection via the elastic net. In some embodiments, these weights are embedded at a firmware level on chips that may not have high numerical precision and/or memory to fit larger values. These weight values will be uploaded to a data store, and eventually loaded onto the exercise machine/bike firmware.

Advantages of the present embodiment will be apparent to those skilled in the art, including that embodiments disclosed herein can effectively achieve a reduction of user action and shorten the required sensing time.

The foregoing disclosure is not intended to limit the present invention to the precise forms or particular fields of use disclosed. As such, it is contemplated that various alternate embodiments and/or modifications to the present disclosure, whether explicitly described or implied herein, are possible in light of the disclosure. Having thus described embodiments of the present disclosure, persons of ordinary skill in the art will recognize advantages over conventional approaches and that changes may be made in form and detail without departing from the scope of the present disclosure.

What is claimed is:

1. An exercise apparatus comprising:

a frame;

a flywheel rotatably coupled to the frame and manually rotatable by an operator;

a resistance apparatus coupled to the frame and adapted to vary a resistance applied to the flywheel, the resistance apparatus comprising:

an adjusting bracket comprising a magnet;

an actuator configured to position the adjusting bracket relative to the flywheel to apply resistance to the rotation of the flywheel based at least in part on a proximity of the magnet to the flywheel; and a load cell configured to generate a signal corresponding to a sensed position of the resistance apparatus relative to the flywheel, the load cell having a first end attached to the adjusting bracket and a second end attached to the frame, wherein the signal represents a reaction force applied to the first end of the load cell by the adjusting bracket as positioned by the actuator; and control components configured to determine a resistance value applied to the flywheel, based at least in part on the signal generated by the load cell.

2. The exercise apparatus of claim 1, wherein the control components are further configured to:

receive an instruction to adjust the resistance applied to the flywheel;

determine a position of the actuator corresponding to the adjusted resistance;

generate a signal to drive the actuator to the determined position to adjust the resistance applied to the flywheel; and calculate the resistance applied to the flywheel by the magnetic based at least in part on the signal received from the load cell.

3. The exercise apparatus of claim 1, wherein the second end of the load cell is pivotably connected to the frame via a mounting bracket; and wherein the adjusting bracket is supported, at least in part, by the first end of the load cell.

4. The exercise apparatus of claim 1, wherein the controller is further configured to calibrate the resistance apparatus in accordance with a load cell calibration routine, the load cell calibration routing comprising:

instructing the actuator to lower the adjusting bracket to or adjacent to an edge of the flywheel and then traverse a plurality of adjusting bracket positions;

reading, at each adjusting bracket position, the signal generated by the load cell; and creating a load cell lookup table comprising load cell signal values and corresponding actuator positions.

5. The exercise apparatus of claim 4, wherein the controller is further configured to execute a start-up routing comprising:

determining whether a valid load cell lookup table is stored in memory and running the load cell calibration routine if a valid load cell lookup table is not found to build and store a new load cell lookup table;

reading a current load cell signal value; and determining a corresponding actuator position based on the load cell signal value and a corresponding actuator position from the table.

6. The exercise apparatus of claim 4 wherein controller is further configured to determine an offset value for the load cell signal to address signal drift, and wherein the controller is further configured to apply the offset to signal readings when determining a position based on the load cell lookup table.

7. The exercise apparatus of claim 4, wherein actuator comprises a stepper motor and wherein the load cell calibration routine comprises driving the stepper motor to position the adjusting bracket to touch the flywheel and wherein the position values in the load cell lookup table represent a number of steps of the stepper motor from the flywheel;

wherein the controller is further configured to generate an instruction to drive the actuator to a target position corresponding to a target resistance value, based at least in part on a current signal generated by the load cell and the corresponding actuator position in the load cell lookup table; and wherein the instruction includes a corresponding number of steps from a current position of the actuator to the target position of the actuator.

8. The exercise apparatus of claim 4, wherein the controller is further configured to determine a current resistance by comparing a fixed table of resistance values to actuator position with the load cell lookup table and wherein an error signal is calculated as a difference between the resistance generated from the load cell lookup table, and one that is found using the fixed table.

9. A system comprising:

a resistance apparatus configured to apply a resistance to a rotation of a flywheel, the resistance apparatus comprising:

an adjusting bracket;

a magnetic member mounted to the adjusting bracket;

an actuator configured to position the adjusting bracket relative to the flywheel including a first position wherein the magnetic member is positioned adjacent to the flywheel providing a first resistance to the rotation of the flywheel and a second position wherein the magnetic member is positioned at a distance further away from the flywheel providing a second resistance to the rotation of the flywheel that is less than the first resistance;

a load cell having a first end attached to the adjusting bracket and a second end attached to a frame, wherein the load cell generates a signal representing a reaction force applied to the first end of the load cell by the adjusting bracket as positioned by the actuator; and a controller configured to:

receive an instruction to adjust the resistance applied to the flywheel;

determine a position of the actuator corresponding to the adjusted resistance;

generate a signal to drive the actuator to the determined position to adjust the resistance applied to the flywheel; and calculate the resistance applied to the flywheel by the magnetic member based at least in part on the signal received from the load cell.

10. The system of claim 9, wherein the second end of the load cell is pivotably connected to the frame via a mounting bracket; and wherein the adjusting bracket is supported, at least in part, by the first end of the load cell.

11. The system of claim 9, further comprising a controller configured to calibrate the resistance apparatus in accordance with a load cell calibration routine, the load cell calibration routing comprising:

instructing the actuator to lower the adjusting bracket to or adjacent to an edge of the flywheel and then traverse a plurality of adjusting bracket positions;

reading, at each adjusting bracket position, the signal generated by the load cell; and creating a load cell lookup table comprising load cell signal values and corresponding actuator positions.

12. The system of claim 11, wherein the controller is further configured to execute a start-up routing comprising:

determining whether a valid load cell lookup table is stored in memory and running the load cell calibration routine if a valid load cell lookup table is not found to build and store a new load cell lookup table;

reading a current load cell signal value; and determining a corresponding actuator position based on the load cell signal value and a corresponding actuator position from the table.

13. The system of claim 12 wherein controller is further configured to determine an offset value for the load cell signal to address signal drift, and wherein the controller is further configured to apply the offset to signal readings when determining a position based on the load cell lookup table.

14. The system of claim 12, wherein the controller is further configured to generate an instruction to drive the actuator to a target position corresponding to a target resistance value, based at least in part on a current signal generated by the load cell and the corresponding actuator position in the load cell lookup table; and wherein the instruction includes a corresponding number of steps from a current position of the actuator to the target position of the actuator.

15. The system of claim 11, wherein actuator comprises a stepper motor and wherein the load cell calibration routine comprises driving the stepper motor to position the adjusting bracket to touch the flywheel and wherein the position values in the load cell lookup table represent a number of steps of the stepper motor from the flywheel.

16. The system of claim 11, wherein the controller is further configured to determine a current resistance by comparing a fixed table of resistance values to actuator position with the load cell lookup table and wherein an error signal is calculated as a difference between the resistance generated from the load cell lookup table, and one that is found using the fixed table.

17. A method comprising:

controlling a resistance applied to a flywheel of an exercise apparatus using an actuator configured to position a magnet of an adjusting bracket relative to the flywheel and feedback from a load cell having a first end attached to the adjusting bracket and a second end attached to a frame of the exercise apparatus, wherein the load cell generates a signal representing a reaction force applied to the first end of the load cell by the adjusting bracket as positioned by the actuator;

receiving a target resistance to apply to a flywheel of an exercise apparatus;

determining a target actuator position corresponding to the target resistance based at least in part on a current actuator position determined based on looking up a current load cell signal in a lookup table; and driving the actuator to the target actuator position based on a number of steps from a current position to the target position.

18. The method of claim 17, further comprising:

receiving an instruction to adjust the resistance applied to the flywheel;

determining a position of the actuator corresponding to the adjusted resistance;

generating a signal to drive the actuator to the determined position to adjust the resistance applied to the flywheel;

receiving the signal from the load cell; and calculating the resistance applied to the flywheel by the magnetic based at least in part on the signal received from the load cell.

19. The method of claim 17, further comprising executing a load cell calibration routing comprising:

instructing the actuator to lower the adjusting bracket to or adjacent to an edge of the flywheel and then traverse a plurality of adjusting bracket positions;

reading, at each adjusting bracket position, the signal generated by the load cell;

creating a load cell lookup table comprising load cell signal values and corresponding actuator positions.

20. The method of claim 19, further comprising executing a start-up routing comprising:

determining whether a valid load cell lookup table is stored in memory and running the load cell calibration routine if a valid load cell lookup table is not found to build and store a new load cell lookup table;

reading a current load cell signal value; and determining a corresponding actuator position based on the load cell signal value and a corresponding actuator position from the table.

* * * * *